US008711688B1

(12) United States Patent
Smith et al.

(10) Patent No.: US 8,711,688 B1
(45) Date of Patent: Apr. 29, 2014

(54) TRAFFIC FLOW ANALYSIS MITIGATION USING A COVER SIGNAL

(75) Inventors: Edward Smith, Escondido, CA (US); Donald Wilcoxson, Carlsbad, CA (US); Shay Har-Noy, San Diego, CA (US)

(73) Assignee: VIASAT, Inc., Carlsbad, CA (US)

( * ) Notice: Subject to any disclaimer, the term of this patent is extended or adjusted under 35 U.S.C. 154(b) by 273 days.

(21) Appl. No.: 13/092,859

(22) Filed: Apr. 22, 2011

Related U.S. Application Data

(60) Provisional application No. 61/326,723, filed on Apr. 22, 2010.

(51) Int. Cl.
*G08C 15/00* (2006.01)

(52) U.S. Cl.
USPC ..... 370/229; 380/252

(58) Field of Classification Search
USPC ..... 370/229; 380/31, 252–254
See application file for complete search history.

(56) References Cited

U.S. PATENT DOCUMENTS 4,688,257 A * 8/1987 Erickson ..... 380/274
2007/0293142 A1* 12/2007 Dehmas et al. ..... 455/1
2010/0033305 A1* 2/2010 Korgaonkar et al. ..... 340/10.1
2010/0220016 A1* 9/2010 Nissinen et al. ..... 343/702
2011/0033051 A1* 2/2011 Steer et al. ..... 380/270
2011/0219459 A1* 9/2011 Andreasson ..... 726/28
2011/0249596 A1* 10/2011 Ross et al. ..... 370/276
2011/0279237 A1* 11/2011 Loh et al. ..... 340/10.1
2013/0010951 A1* 1/2013 Britz et al. ..... 380/33

* cited by examiner

*Primary Examiner* — Mark Rinehart
*Assistant Examiner* — Christopher R Crompton
(74) *Attorney, Agent, or Firm* — Knobbe Martens Olson & Bear, LLP

(57) ABSTRACT

Network communications face security issues including traffic flow analysis attacks. Such attacks include deduction of information about networks through analysis of transmitted traffic volume or statistics, even if the traffic is encrypted. For example, an adversary may deduce operational information from traffic volume, or its timing. Described herein are security techniques that can provide transmission security with an obfuscating "cover" signal for any contention-based multiple access system by employing signal interference cancellation techniques, but are not so limited. The cover signal is transmitted on the same frequency band used by terminals on the network. Using "known-signal" and/or self-interference cancellation techniques, the cover signal can be removed by authorized terminals that have appropriate cover signal information and timing synchronization. An adversary cannot distinguish between real traffic and the cover signal while authorized terminals can recover transmissions without impact to network capacity.

17 Claims, 20 Drawing Sheets

TRAFFIC FLOW ANALYSIS MITIGATION USING A COVER SIGNAL

CROSS REFERENCE TO RELATED APPLICATIONS

This disclosure claims priority to U.S. Provisional Application No. 61/326,723, filed Apr. 22, 2010, entitled "TRAFFIC FLOW ANALYSIS MITIGATION USING A COVER SIGNAL." The disclosure of the prior application is considered part of, and is incorporated by reference in, this disclosure.

BACKGROUND

1. Field

The present technology relates to information security. More particularly, the technology relates to security techniques for protecting networks from traffic flow analysis. The technology is relevant generally to network communications, including networks with contention-based multiple access architectures.

2. Description of the Related Art

Traffic flow analysis attacks refer to the situation in which an adversary attempts to deduce information about the network and its users by analyzing the transmitted traffic. Although encryption methods have become increasingly sophisticated, a determined adversary can still derive valuable information by analyzing the statistics of traffic on the network, for example the volume or its timing, even though the information relayed between users on the network may be encrypted. This type of threat is relevant to any network communications where an adversary is able to receive transmitted traffic in a network. This type of threat is especially relevant for "bent-pipe" satellite communication systems since the return link is reflected by the satellite back to the earth without change to the original modulation and can easily be observed by an adversary over wide geographic areas.

Commonly, bent-pipe satellite communication systems operate in an asymmetric network fashion, meaning many remote terminals are serviced from a single hub terminal via satellite. The remote terminals send their return signals to the hub and the hub in turn sends a single forward signal to all of the remote terminals, where this forward signal is a shared transport medium for all data going from the hub site to the remote terminals, for example as a time-division multiplexed (TDM) carrier. This asymmetric network configuration is often referred to as "hub-spoke" or "star" for example. The remote terminals typically transmit and receive using small satellite antennas (typical ranges from sub-1m up to ~2 m depending on frequency bands, including ones as small as ~0.3-0.6 m or smaller in diameter) while the hub terminal transmits and receives using a significantly larger satellite antenna (~2.4-4.5 m or larger) at a significantly larger power output.

A typical satellite in an asymmetric bent-pipe communication network scheme includes a number of repeaters on the satellite (transponders), each of which provides a large-capacity communication channel. Each transponder has a receiver tuned to a frequency range (bandwidth) that has been allocated for uplink communication signals from Earth to the satellite. Following the receiver, each transponder includes a frequency translator to change the received signals to a downlink frequency suitable for satellite-to-Earth transmission, a filter tuned to the frequency of the transponder, and a power amplifier to transmit signals back to Earth. This means that all signals uplinked to the satellite are downlinked throughout the entire range of coverage including (in many cases) the location from which the uplink transmission was made.

In order to minimize the required bandwidth of the system, a frequency sharing technique can be utilized in which the return channels occupy the same physical bandwidth as the forward channel (e.g., ViaSat's Paired Carrier Multiple Access (PCMA) technique, for example as used in the ArcLight® Satellite Communications System. Descriptions of frequency sharing systems and techniques can be found in U.S. Pat. Nos. 6,011,952, 6,725,017, 6,907,093, among others.). This technique can reduce the bandwidth required by the system by up to half, which can also reduce the number of transponders used.

In a typical asymmetric frequency sharing satellite communication system installation, the remote terminal signals are transmitted back down to earth by the satellite along with the forward signal, occupying the same bandwidth. Because the hub antenna tends to be transmitting essentially constantly to unknown recipients, analyzing the forward hub traffic when encryption is used would likely not produce much information. However, an adversary in the vicinity of the remote terminals or the hub could remove the strong and detectable forward signal by studying the received symbols and deriving the modulation scheme. Commercial products capable of this functionality, such as those made by GlowLink, already exist and are available for purchase. After removing the forward signal an adversary would be able to see the amount of traffic on the return downlinks and derive information about the number of users in the network or the amount of traffic communicated by these users. In many applications this type of privacy breach could be detrimental.

Consider the scenario of a military unit beginning an operation. Using simple traffic flow analysis an adversary could identify the increase in remote terminal traffic and infer that a unit is preparing for an operation. This would allow the adversary to take measures to prepare for such a mission and thus the element of surprise may be lost. Another illustrative scenario might be an unmanned aerial vehicle (UAV) flying at a high altitude in order to observe places and people on the ground. By performing traffic analysis an adversary may see an increase in data traffic and know that they "are being watched" and attempt to conceal their activity.

One straightforward method for concealing traffic on the network is to have remote terminals constantly transmit regardless of the actual traffic they may have to send. Thus the remote terminals transmit so-called "dummy" bursts in order to make the network seem constantly utilized. This is a common technique used for time-division multiple access (TDMA) networks as part of an overall transmission security method. However, in a contention channel this has the disadvantage of creating unnecessary traffic, and thus self-induced interference or packet collisions, reducing the throughput of the network available for actual traffic, while not necessarily completely obfuscating the actual user traffic. For example, dummy packets may not completely obfuscate the actual user traffic unless transmitted at a high enough volume. However, transmitting at a volume sufficient to obfuscate the actual user traffic may not be possible, as the necessary volume may make it impossible to then transmit real traffic. Furthermore, in the case for which the remote terminals are power limited, as in the case of many mobile terminals, for example those powered by a battery, the transmission of dummy bursts consumes valuable terminal power.

In spite of the undesired increase in packet collisions and wasting of terminal power, the dummy burst method described above is currently the only method identified to mitigate traffic flow analysis attacks.

SUMMARY

The systems, methods, and devices described herein each may have several aspects, no single one of which is solely responsible for its desirable attributes. Without limiting the scope of this disclosure as expressed by the claims which follow, its more prominent features will now be discussed briefly. After considering this discussion, and particularly after reading the section entitled "Detailed Description" one will understand how the features of this technology provide advantages that include preventing traffic flow analysis attacks.

One aspect of this disclosure is a method for inhibiting traffic flow analysis attacks in a wireless, multiple access communications network. The method comprises receiving, within the wireless, multiple access communications network, a composite signal comprising a cover signal and one or more user transmissions. The cover signal has one or more characteristics that mimic the one or more user transmissions. The method further comprises cancelling the cover signal from the composite signal to produce the one or more user transmissions. Cancelling the cover signal comprises determining one or more signal characteristics of the cover signal. Cancelling the cover signal further comprises re-creating a copy of the cover signal based at least in part on the determined one or, more signal characteristics. Cancelling the cover signal further comprises subtracting the copy of the cover signal from the composite signal to produce the one or more user transmissions. The method further comprises demodulating the one or more user transmissions.

Another aspect of this disclosure is a system for inhibiting traffic flow analysis attacks in a wireless, multiple access communications network. The system comprises one or more user terminals configured to transmit one or more user transmissions within the wireless, multiple access communications network. The system further comprises a cover signal generator configured to generate a cover signal. The cover signal has one or more characteristics that mimic the one or more user transmissions. The system further comprises a cover signal canceller configured to receive a composite signal comprising the cover signal and the one or more user transmissions. The cover signal canceller is further configured to cancel the cover signal from the composite signal to produce the one or more user transmissions. The cover signal canceller is configured to cancel the cover signal by determining one or more signal characteristics of the cover signal. The cover signal canceller is further configured to cancel the cover signal by re-creating a copy of the cover signal based at least in part on the determined one or more signal characteristics. The cover signal canceller is further configured to cancel the cover signal by subtracting the copy of the cover signal from the composite signal to produce the one or more user transmissions.

Another aspect of this disclosure is an apparatus for inhibiting traffic flow analysis attacks in a wireless, multiple access communications network. The apparatus comprises a receiver configured to receive, within the wireless, multiple access communications network, a composite signal comprising a cover signal and one or more user transmissions. The cover signal has one or more characteristics that mimic the one or more user transmissions. The apparatus further comprises a canceller configured to cancel the cover signal from the composite signal to produce the one or more user transmissions. The canceller is configured to cancel the cover signal by determining one or more signal characteristics of the cover signal. The canceller is further configured to cancel the cover signal by re-creating a copy of the cover signal based at least in part on the determined one or more signal characteristics. The canceller is further configured to cancel the cover signal by subtracting the copy of the cover signal from the composite signal to produce the one or more user transmissions. The apparatus further comprises a demodulator configured to demodulate the one or more user transmissions.

Another aspect of this disclosure is an apparatus for inhibiting traffic flow analysis attacks in a wireless, multiple access communications network. The apparatus comprises means for receiving, within the wireless, multiple access communications network, a composite signal comprising a cover signal and one or more user transmissions. The cover signal has one or more characteristics that mimic the one or more user transmissions. The apparatus further comprises means for cancelling the cover signal from the composite signal to produce the one or more user transmissions. The means for cancelling comprises means for determining one or more signal characteristics of the cover signal. The means for cancelling further comprises means for re-creating a copy of the cover signal based at least in part on the determined one or more signal characteristics. The means for cancelling further comprises means for subtracting the copy of the cover signal from the composite signal to produce the one or more user transmissions. The apparatus further comprises means for demodulating the one or more user transmissions.

Another aspect of this disclosure is a computer readable medium comprising instructions that, when executed, cause an apparatus to perform a method for inhibiting traffic flow analysis attacks in a wireless, multiple access communications network. The method comprises receiving, within the wireless, multiple access communications network, a composite signal comprising a cover signal and one or more user transmissions. The cover signal has one or more characteristics that mimic the one or more user transmissions. The method further comprises cancelling the cover signal from the composite signal to produce the one or more user transmissions. Cancelling the cover signal comprises determining one or more signal characteristics of the cover signal. Cancelling the cover signal further comprises re-creating a copy of the cover signal based at least in part on the determined one or more signal characteristics. Cancelling the cover signal further comprises subtracting the copy of the cover signal from the composite signal to produce the one or more user transmissions. The method further comprises demodulating the one or more user transmissions.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION

The following detailed description is directed to certain specific embodiments. However, the teachings herein can be applied in a multitude of different ways, including for example, as defined and covered by the claims. It should be apparent that the aspects herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. For example, a system or apparatus may be implemented or a method may be practiced using any number of the aspects set forth herein. In addition, such a system or apparatus may be implemented or such a method may be practiced using other structure, functionality, or structure and functionality in addition to or other than one or more of the aspects set forth herein. In this description, reference is made to the drawings wherein like parts are designated with like numerals throughout.

The subject disclosure provides methods and systems to mitigate traffic flow analysis attacks. In one embodiment, the techniques described herein are explained in the context of contention-based multiple access systems, although the utility of such techniques is not limited to such systems. This methods and systems include masking the traffic on a network using an obfuscating "cover" signal, and may be referred to as the cover signal method and/or the cover signal system. Using "known-signal" and/or self-interference cancellation techniques, the cover signal can be removed from the composite signal by authorized terminals to retrieve the user transmissions. For example, an authorized terminal may have knowledge of the content and timing of the cover signal and therefore be able to cancel the cover signal from the composite signal, such as by subtracting the cover signal from the composite signal. Unlike the dummy burst method, use of the cover signal method to generate a cover signal has minimal impact on the throughput of certain systems, e.g., contention based systems, and on remote terminal power consumption.

Figure 1:
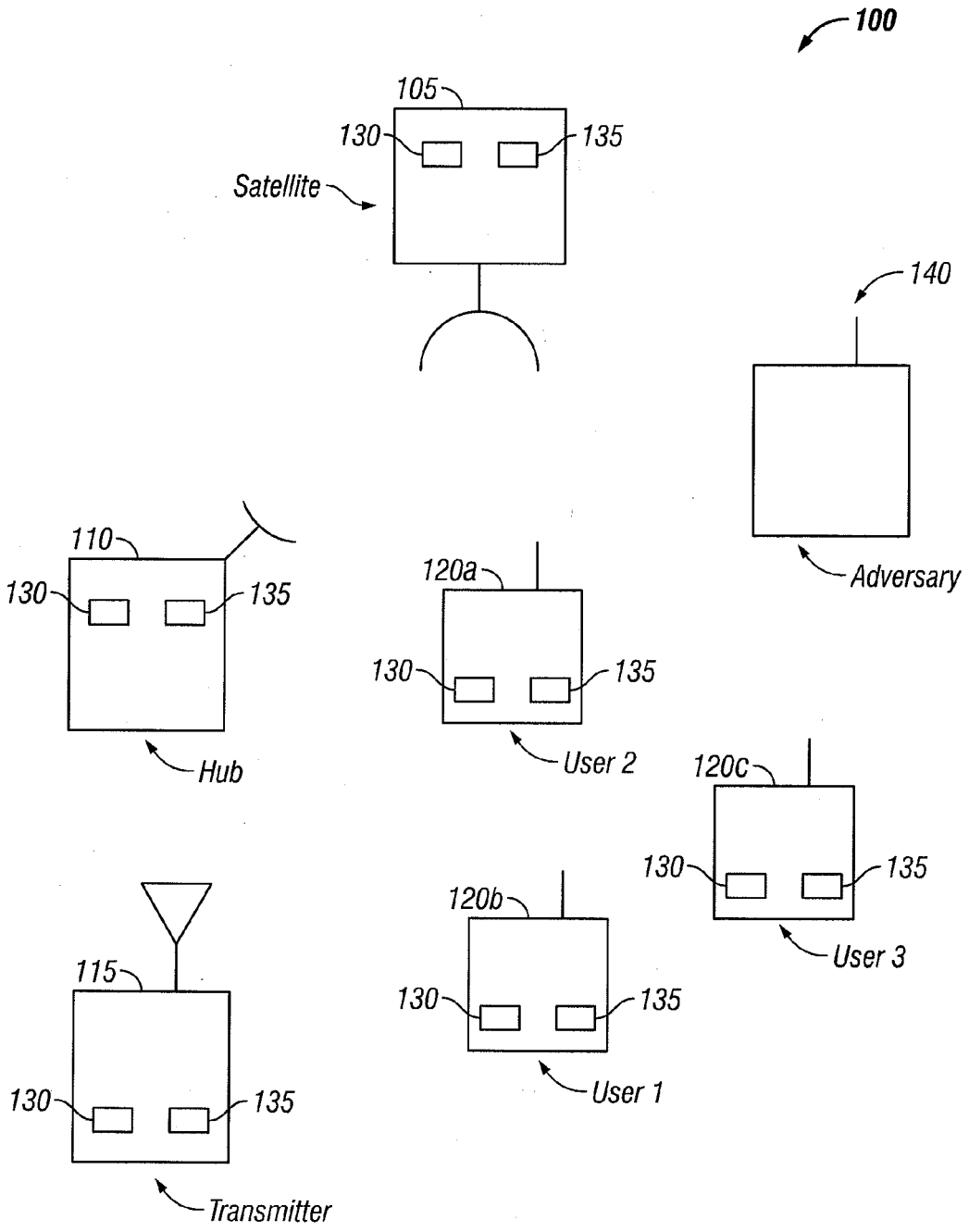
FIG. 1 depicts various network devices that may be in a communications network.

FIG. 1 depicts various devices that may be in a communications network. The devices comprise terminals authorized for communications in the network 100. The devices include a satellite 105, a hub terminal 110, a transmitter 115, and remote or user terminals 120. It should be noted that the devices are merely illustrative of the devices that may be used in a communications network and that other appropriate devices may also be used to perform the techniques described herein. Further, a communications network does not need to include all of the devices illustrated in FIG. 1. The devices may communicate with each other by transmitting and receiving user transmissions between one another.

In FIG. 1, each of the devices 105, 110, 115, and 120 are illustrated as containing a cover signal generator 130 for transmitting a cover signal and a canceller 135 configured to cancel the cover signal from a received composite signal. In many implementations of such a system, however, and as described further below, only one or some subset of the units may actually include one or the other, or both of these components, while other units of the system omit one, or the other, or both. Thus, any one of the one or more devices may include a cover signal generator 130 and transmit the generated cover signal in the communications network. Further, any one or more of the devices may include a canceller 135 configured to cancel the cover signal from a received composite signal comprising user transmissions and the cover signal. Accordingly, any device with a canceller 135 may retrieve user transmissions in the communications network even when a cover signal is being generated.

An adversary terminal 140 may also be able to receive the communications transmitted by the devices. For example, the adversary terminal 140 may receive the user transmissions and the cover signal as a composite signal. Unlike the devices 105, 110, 115, and 120, the adversary terminal 140 does not include a canceller 135 capable of removing the cover signal. Accordingly, when a cover signal is generated in the communications network, the adversary terminal 140 is unable to extract user transmissions from the composite signal.

Figure 2:
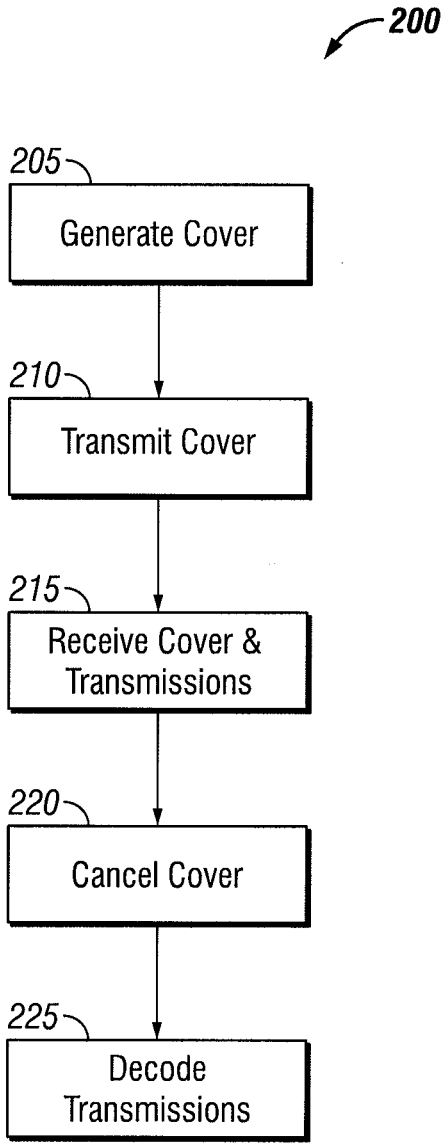
FIG. 2 depicts a flowchart illustrating a method for the devices of FIG. 1 to communicate in a communications network using a cover signal.

FIG. 2 depicts a flowchart illustrating a method 200 for the devices to communicate in a communications network using a cover signal. At a step 205, one of the devices generates a cover signal using the cover signal generator 130. Further, at a step 210, the device that generates the cover signal using the cover signal generator 130 transmits the cover signal in the communications network. Further, at a step 215, the devices in the communications network receive a composite signal comprising the cover signal and user transmissions in the communications network. Continuing, at a step 220, the devices having a canceller 135 cancel the cover signal from the composite signal to retrieve the user transmissions. In order to cancel the cover signal from the composite signal, the devices need information regarding the cover signal content and timing. Accordingly, cancellation of the cover signal may be based on such information, as discussed in further detail below.

Figure 3:
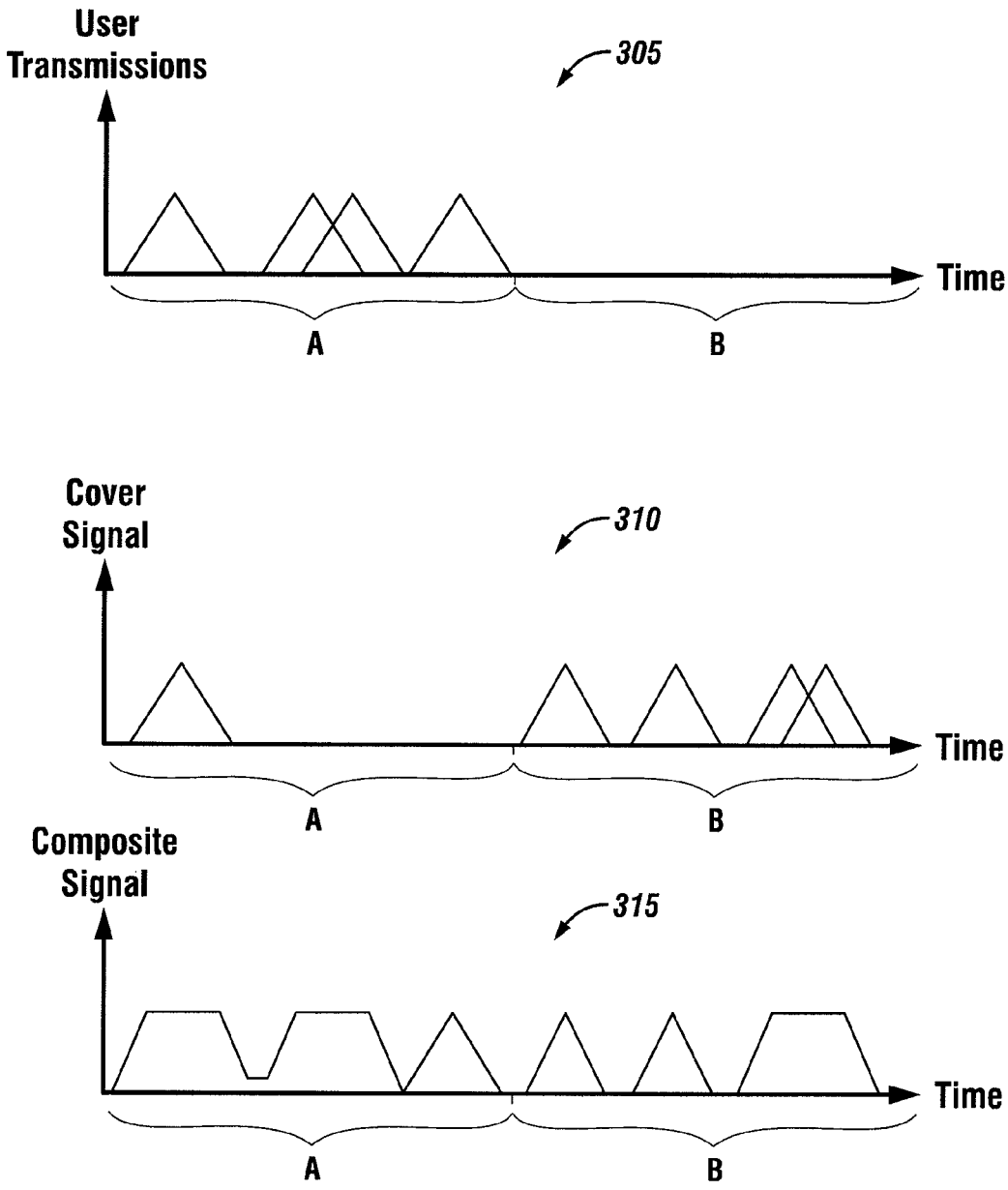
FIG. 3 depicts representations of signals used in a communications network using a cover signal.

At the step 205, the cover signal may be designed to resemble or mimic user transmissions in the communications network. For example, FIG. 3 depicts a graph 305 of an example of user transmissions in the communications network. The amplitude of the user transmissions is shown on the y-axis of the graph 305 and the time at which the transmissions are sent are shown on the x-axis of the graph 305. As shown, the user transmissions vary over time.

The cover signal may mimic the user transmissions in that the cover signal may be generated to have one or more similar signal characteristics as the user transmissions. In one embodiment, the cover signal may be generated such that the sum of the user transmissions and the cover signal produce a composite signal that has traffic characteristics that make it difficult or impossible for an adversary to separate the contributions of the cover signal from the actual data traffic. For example, graph 310 is an example of a cover signal to be used in conjunction with the user transmissions shown in graph 305. As shown, the amplitude and timing of the cover signal is selected to mask the user transmissions. Graph 315 illustrates the composite signal that is received at a device that receives the user transmissions and the cover signal. Looking at just the composite signal, and without the ability to subtract the cover signal, an adversary is unable to isolate actual user transmissions from cover signal transmissions.

To successfully mask the volume of actual user transmissions with the cover signal, it is advantageous if the cover signal mimics one or more characteristics of the actual user transmissions. For example, the cover signal can have similar data content patterns such as similar preambles, block sizes, etc. The characteristics of the transmit beams for the user transmissions and the cover signal can be similar. In addition, the composite signal should present a total traffic volume profile over time that inhibits separate detection of either the traffic volume of the cover signal or the traffic volume of actual user transmissions over that time. That is, if the actual user traffic volume over time has a function f(t), and the cover signal over time has a traffic volume g(t), the composite signal has a traffic volume function $h(t)=f(t)+g(t)$. The cover signal traffic volume g(t) is chosen such that it will be difficult for an adversary to derive either f(t) or g(t) given only knowledge of h(t). In some cases, this can be accomplished by generating more cover signal transmissions when the actual user traffic volume is low. This is illustrated in graphs 305 and 310. In this case, the cover signal in period B of FIG. 3 mimics the actual traffic in period A of FIG. 3 in that cover signal traffic volume in period B is high, and actual user traffic in period A is high. In addition, the cover signal in period A of FIG. 3 mimics the actual traffic in period B of FIG. 3 in that cover signal traffic volume in period A is low, and actual user traffic in period B is low. As another example, if the actual user traffic volume has short duration peaks with low volume quiet periods in between, the cover signal may also contain short duration peaks with low volume quiet periods in between to hide the real traffic peaks in the cover signal peaks. In this case, the cover signal peaks could be pseudo-randomly positioned such that the real traffic peaks are difficult to separate from the cover signal peaks. A random or pseudo-random cover signal could also be used. In general, it is advantageous if the frequency content of the cover signal volume function g(t) has similar characteristics with (e.g. mimics) the frequency content of the user traffic volume function f(t). Thus, the cover signal may be generated to mimic one or more characteristics of the content of real traffic, and may be generated to mimic one or more characteristics of the volume of real traffic so that an adversary cannot deduce the volume of real traffic or the volume of the cover signal when analyzing the volume of the composite signal.

In order to generate a cover signal that mimics user transmissions, the device generating the cover signal may use information about the user transmissions in the network. Such information can be known by receiving the actual user transmissions, either directly or relayed through another device. The device may then generate the cover signal. For example, the device may generate the cover signal when no user transmission are detected, but that have similar signal characteristics as user transmissions received within a certain time period of the generation of the cover signal. The device may not be able to instantly respond to changes in user transmissions when generating the cover signal, but may adjust according to trends in user transmissions.

As discussed above, at the step 220, in order to cancel the cover signal from the composite signal, the devices need information regarding the cover signal. For example, the devices may need information regarding the amplitude, timing, shape, frequency or frequencies on which the cover signal is sent, etc. This information can be shared between each of the devices (like a shared key) such that each of the devices can determine the cover signal used in the composite signal so as to be able to subtract the cover signal. In one embodiment, the information may be shared at the time of manufacture of the devices. In another embodiment, the information may be periodically shared or updated at the devices through some secure channel of communication, such as a back channel. In yet another embodiment, such information is only needed by the device that created the cover signal, which therefore already has the information about the cover signal.

Utilizing this information, the devices can re-create the cover signal that corresponds to the received composite signal and subtract the cover signal from the composite signal to retrieve the user transmissions. For example, a composite signal may be received starting at some time A. The cover signal that is part of the received composite signal may have been generated at a time $A-t_p$ where $t_p$ is the propagation time for the signal to travel from the device that created the cover signal to the device that received the composite signal. The devices may have knowledge of $t_p$ such as by calculating distance and other relevant factors between the devices and the device generating the cover signal. Further, the device receiving the composite signal may have additional information regarding the cover signal, such as discussed above, to recreate the cover signal that was created at time $A-t_p$. In another embodiment, $A-t_p$ may be known according to a timestamp transmitted with the cover signal. The recreated cover signal may then be subtracted from the composite signal by the canceller 135. In one embodiment, the creation time (e.g., $A-t_p$) acts as a seed to the cover signal generator 130, such that any device with the cover signal generator 130 can generate the same cover signal when seeded with the same value. Accordingly, in such an embodiment, the device receiving the composite signal may seed its own cover signal generator 130 with the creation time of the cover signal and then subtract the generated cover signal from the composite signal using the canceller 135.

At a step 225, the device that retrieves the user transmissions from the composite signal may decode the user transmissions based on how the user transmission was coded (e.g., modulation scheme, encryption, compression, etc.). The information to decode the user transmission may be shared between each of the devices similar to the information regarding the cover signal.

Figure 4:
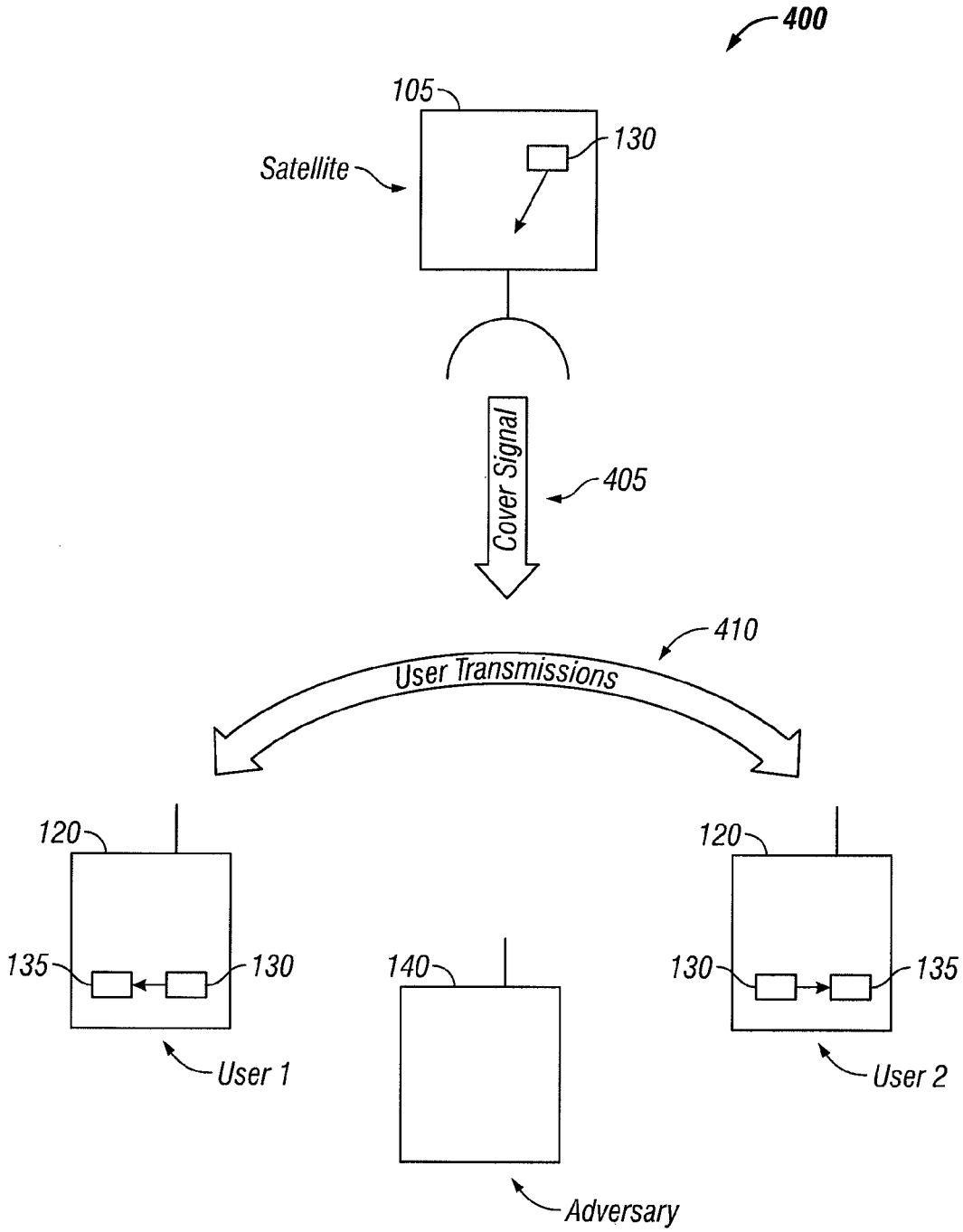
FIG. 4 depicts an exemplary communications network in which the cover signal system is implemented.

FIG. 4 depicts a first exemplary communications network 400 in which the system is implemented. As shown, a satellite 105 includes a cover signal generator 130. The satellite 105 transmits a cover signal 405 over an area. Within the area, two user terminals 120 share user transmissions 410. An adversary 140 within the area may also receive the user transmissions 410. However, since the cover signal 405 is transmitted by the satellite 105 in the area, the two user terminals 120 as well as the adversary 140 receive the user transmissions 410 along with the cover signal 405 as a composite signal. The user terminals 120 have a canceller 135 coupled to a cover signal generator 130 with which to remove the cover signal 405 from the composite signal to retrieve the user transmissions 410. However, the adversary 140 does not have a canceller 135 coupled to a cover signal generator 130 and therefore cannot remove the cover signal 405 from the composite signal.

Figure 5:
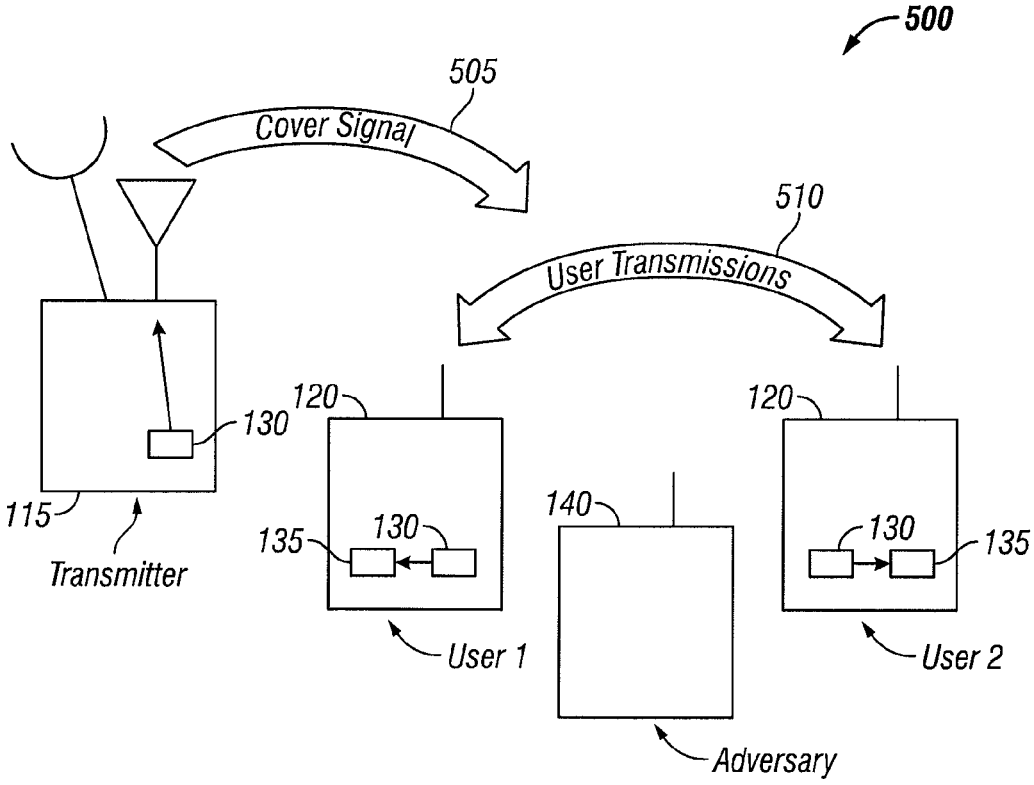
FIG. 5 depicts another exemplary communications network in which the cover signal system is implemented.

FIG. 5 depicts another exemplary communications network 500 in which the system is implemented. As shown, a transmitter 115 includes a cover signal generator 130. In one embodiment, the transmitter 115 may be part of a land based vehicle located near where user transmissions are carried out. It should be noted that though this embodiment is described with respect to the transmitter 115, an appropriate user terminal 120 with a cover generator 130 could be used instead of the transmitter 115 as well. The transmitter 115 transmits a cover signal 505. Near the transmitter 115, two user terminals 120 share user transmissions 510. An adversary 140 near the two user terminals 120 may also receive the user transmissions 510. However, since the cover signal 505 is transmitted by the transmitter 115, the two user terminals 120 as well as the adversary 140 receive the user transmissions 510 along with the cover signal 505 as a composite signal. The user terminals 120 have a canceller 135 coupled to a cover signal generator 130 with which to remove the cover signal 505 from the composite signal to retrieve the user transmissions 510. However, the adversary 140 does not have a canceller 135 coupled to a cover signal generator 130 and therefore cannot remove the cover signal 505 from the composite signal.

Referring now to FIGS. **6*a*-16**, another embodiment of a communications network in which the system is implemented is described. The system of these figures is an especially advantageous application of the principles described above, and can be implemented with minimal changes to existing communication systems. In the following embodiment, the method obfuscates the return channel information of an asymmetric frequency sharing satellite communication system by leveraging the asymmetric nature of the system. The cover signal is transmitted on the same frequency band used by terminals on the network, by other terminals themselves, or by other transmitters near user terminals. In one embodiment of the method, in addition to transmitting its own forward signal, a hub using the method transmits a lower power cover signal on the same frequency band that is designed to look like an aggregate combination of the signals on the return channels. Accordingly, any terminal receiving traffic on such a frequency band receives both the cover signal and user transmissions together as a composite signal. If the cover signal closely resembles or mimics the user transmissions, an adversary terminal may not be able to distinguish between the two in the composite signal and therefore cannot determine any traffic statistics (e.g., volume, timing, etc.) about the user transmissions. Since the hub receives all the remote terminal transmissions, it has a constant update of the traffic on the channel and can use this information to generate a time-varying cover signal that masks the signals generated by the true remote traffic.

In one embodiment, when using a frequency sharing system, since the hub generates this cover signal it can remove it from the received downlink signal using the same cancellation technique it already uses to cancel its own forward transmission (in order to receive the true remote traffic). Thus, the cover signal is treated in a similar way to the forward signal with respect to cancellation at the hub site. This means that minimal alterations need to be made at the hub as the hub is already set to perform signal cancellation. To the remote users, who are expecting to receive the high power forward signal, the cover signal is simply interpreted as a low level of additional noise along with the other remote transmissions and since all are well below the forward channel signal strength in typical system configurations, the remote terminals do not have to perform cancellation. This allows the method to provide a needed increase in security essentially for "free" from a remote terminal cost perspective. Further, with only few modifications necessary at the hub, the method is an inexpensive and easy to implement "add-on" to existing systems. The various embodiments of the systems and methods are described in further detail below with respect to the figures.

FIG. **6*a* shows the uplinks of a generic asymmetric (aka "hub-spoke" or "star" topology) satellite communication system. In the figure, two remote terminals 120 are shown transmitting their return signals up to a target satellite 105 creating return uplinks 1 and 2 while a hub terminal 110 is transmitting its (shared) forward signal up to the same satellite 105 establishing the forward uplink. It should be noted that there could be just one or many remote terminals 120** but only two are depicted here for clarity. The forward uplink is shown using a large arrow as a reminder that the forward signal is transmitted with significantly more power than the return signals.

Figure 6A:
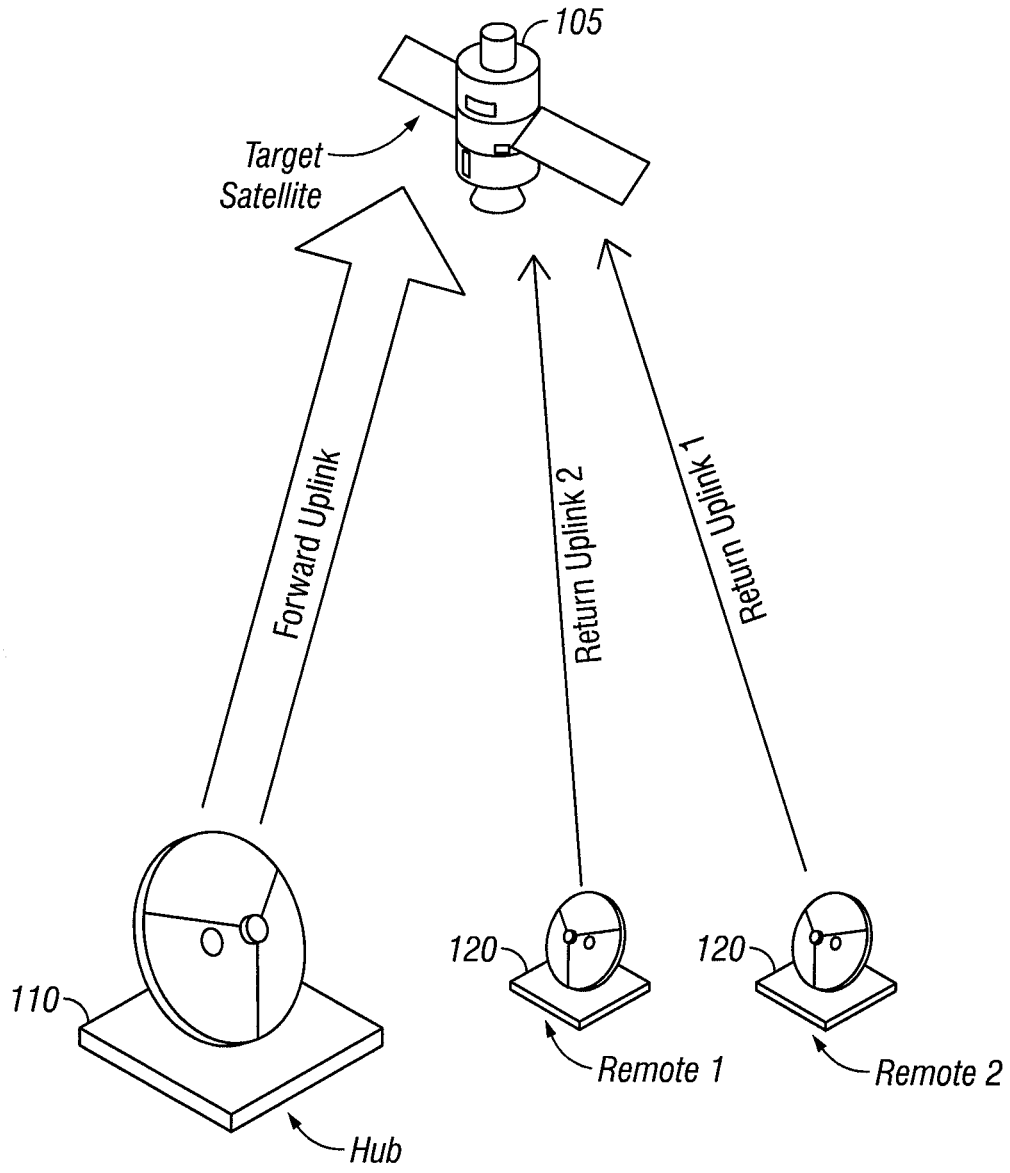
FIG. 6*a* shows the uplinks of a generic asymmetric (hub-spoke) satellite communication system.

FIG. **6*b* shows that the hub 110 and remote terminals 120 will receive both the forward and return signals creating the forward and return downlinks as in a typical loopback satellite beam. Dashed lines are used for the downlinks that are not desired by the respective terminal but are nonetheless established. If the terminals 120 and hub 110 seen in FIG. 6*a* are all tuned to transmit on the same frequency, as in a frequency sharing system, then the undesired signal received by the respective terminals 120 and hub 110** cannot be trivially removed.

Figure 7A:
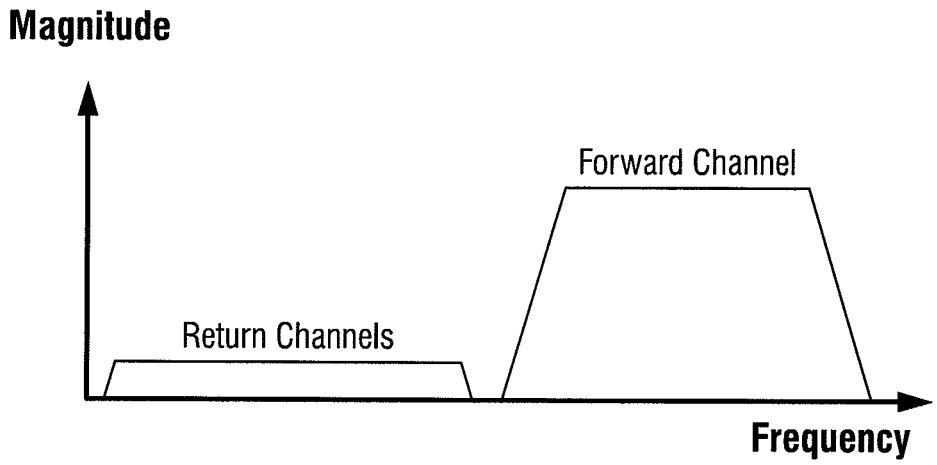
FIG. 7*a* illustrates the spectrum of the return and forward channels in a typical asymmetric satellite communication system.
Figure 7B:
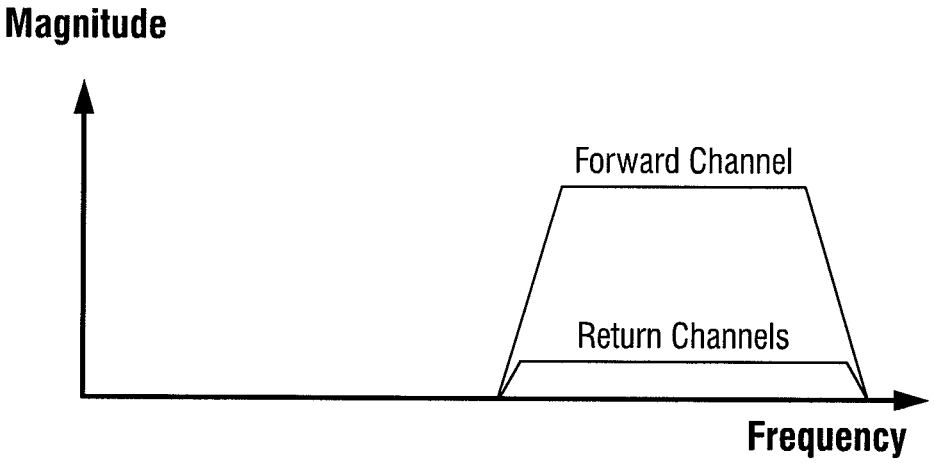
FIG. 7*b* illustrates the spectrum of the return and forward channels in an asymmetric frequency sharing satellite communication system.

FIG. **7*a* and FIG. 7*b* are provided to better understand the concept of frequency sharing. FIG. 7*a* shows the spectrum for the forward and return channels in a typical asymmetric system, where the return channels and forward channel occupy a different set of frequencies. FIG. 7*b* shows how the spectrum changes in a frequency sharing system as the return channels are now contained within the same frequency band as the forward channel and are separable from each other due to the structure of their signaling. Because the system is assumed to be bent-pipe, meaning that the downlink signals transmitted by the satellite are simply a filtered, frequency translated, and amplified version of the original uplink signals, anyone listening on the channel will be able to receive the actual forward and return signals. The overall received downlink signal is a combination of the forward and return signals. The remote terminals 120 are only interested in the forward signal which is typically received at a much higher power level than the return signals. Therefore, the remote terminals 120 will treat the aggregate of return signals as low power noise which has minimal effect on reception of the forward link. This is not true for the hub 110 since its own signal dominates those of the remote terminals 120** that it is trying to receive.

Figure 6B:
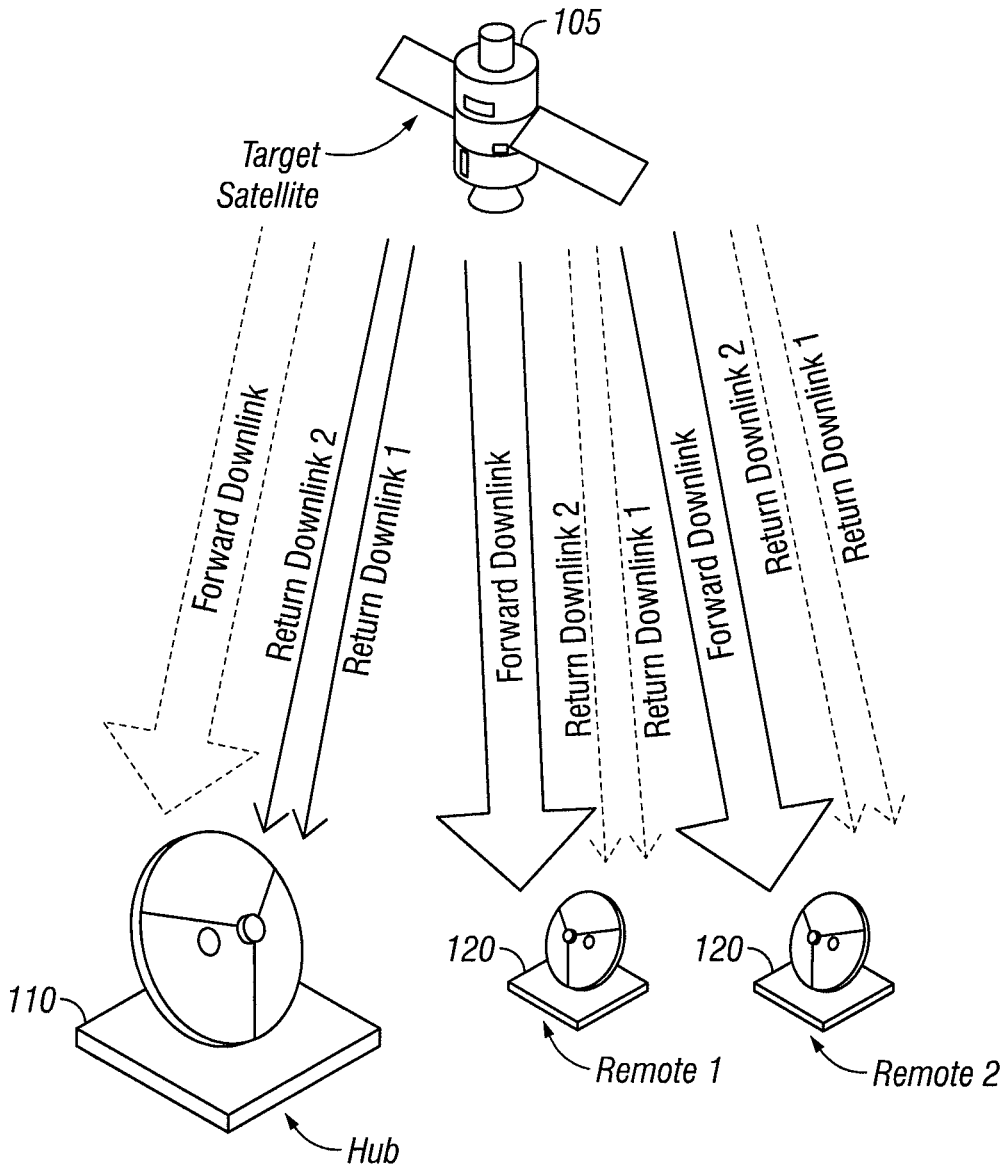
FIG. 6*b* shows the downlinks of a generic asymmetric satellite communication system.
Figure 8:
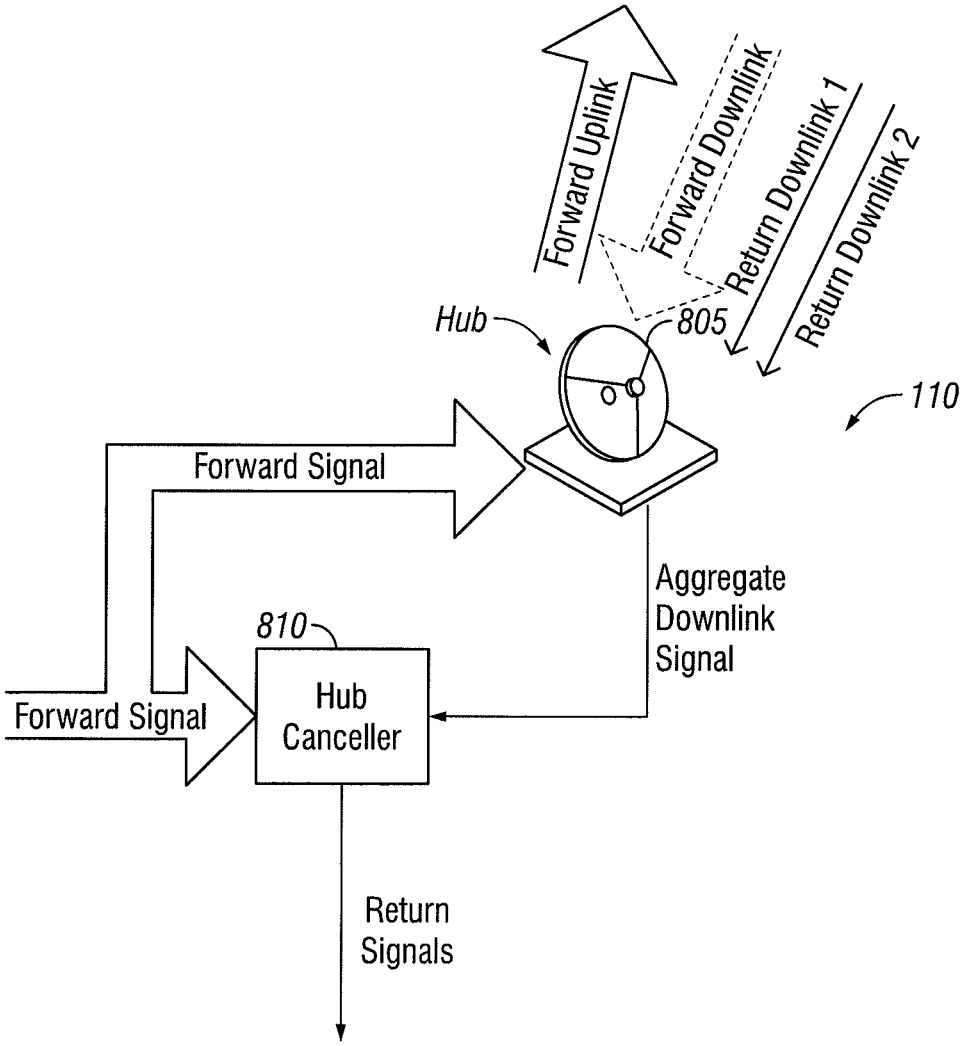
FIG. 8 is a simplified block diagram of the signal processing done at the hub of a frequency sharing satellite communication system.

As seen in FIG. 6*b* and as explained above, the hub 110 receives its own transmitted high power forward signal in addition to the low power return signals. This forward signal may need to be removed from the received downlink signal in order to obtain the desired return signals. As discussed above, this can be done using a cancellation technique embodied in a device such as the canceller 135 discussed above, although other implementation can be used. The device may be called a "hub canceller" herein and may have the same or similar functionality and structure as the canceller 135. The simplified block diagram in FIG. 8, which depicts the basic signal processing done at the hub 110, shows the forward signal provided to both the hub antenna 805 for transmission and to the hub canceller 810 (which may comprise the canceller 135). The hub canceller 810 subtracts the forward signal contribution from the aggregate downlink signal input and outputs the desired return signals, plus any residual errors due to estimation errors in the cancellation process.

Figure 9:
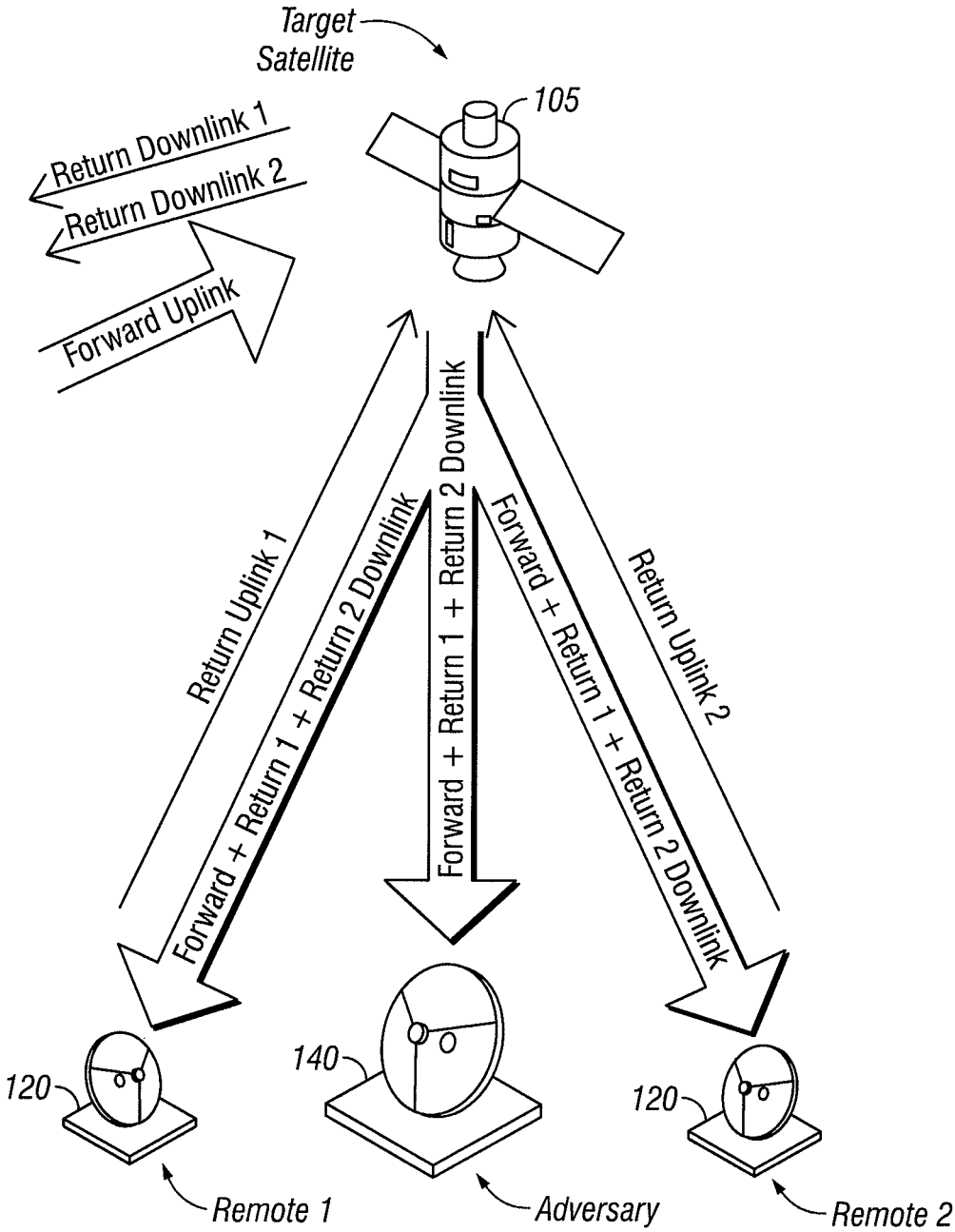
FIG. 9 shows an adversary receiving the downlink information from a frequency sharing satellite communication system.

As previously described, both the hub 110 and remote terminals 120 receive their own downlink signals and those of the other terminals in a loopback satellite configuration. Therefore, an adversary 140 in the service area of the hub 110 or remote terminals 120 listening in on the forward/return channel would also receive all of these downlink signals. The case where the adversary 140 is in the remote terminal service area, which is a likely case, is shown in FIG. 9. The overall downlink depicted by the large shadowed arrows contains the forward signal from the hub 110 and return signals from remotes terminals 120. The adversary 140 would then simply remove the high power forward signal, which can be easily done using commercially available satellite spectrum interference monitoring equipment, to obtain the return signals and thus deduce potentially valuable information about the return network traffic.

Figure 10:
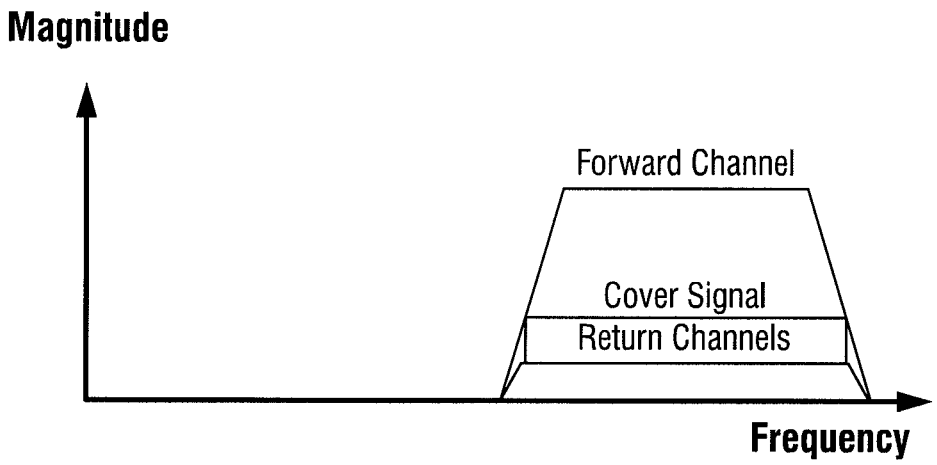
FIG. 10 illustrates how a cover signal can be used to mask the return channels.

As discussed above, a method for preventing the security breach seen in FIG. 9 would be for an obfuscating cover signal to be transmitted in order to mask the return signals. An illustration clarifying this suggested method is seen in FIG. 10 where a low power (relative to the forward channel) cover signal is transmitted along the same frequency band as the return and forward signals. As seen in FIG. 10, the cover signal is low power like the return channels but is designed to "mask" the return channels.

As discussed above, the cover signal may be chosen in such a way as to make it practically indistinguishable from the remote traffic after the forward link has been removed, thus creating the appearance of additional users. For example, if the system normally picks out individual users by searching for their preamble, the cover signal could be chosen so that it contains signaling either duplicating or resembling the same preambles as actual traffic, therefore making the cover signal indistinguishable from the actual users' signals. Furthermore, the simulated users in the cover signal may be random and time-varying in such a way so that an adversary cannot determine when there is a genuine increase in the remote terminal traffic. Thus, one possibility for a cover signal is to have preambles followed by fake traffic to generate "false remote terminals" where the total traffic seen by an adversary (i.e. the true remote terminals and the false terminals) is either constant or constantly varying regardless of the true remote terminal content. The cover signal may be designed in such a way that it resembles the sum of the remote terminals and therefore presents the same statistics as actual traffic.

Figure 11:
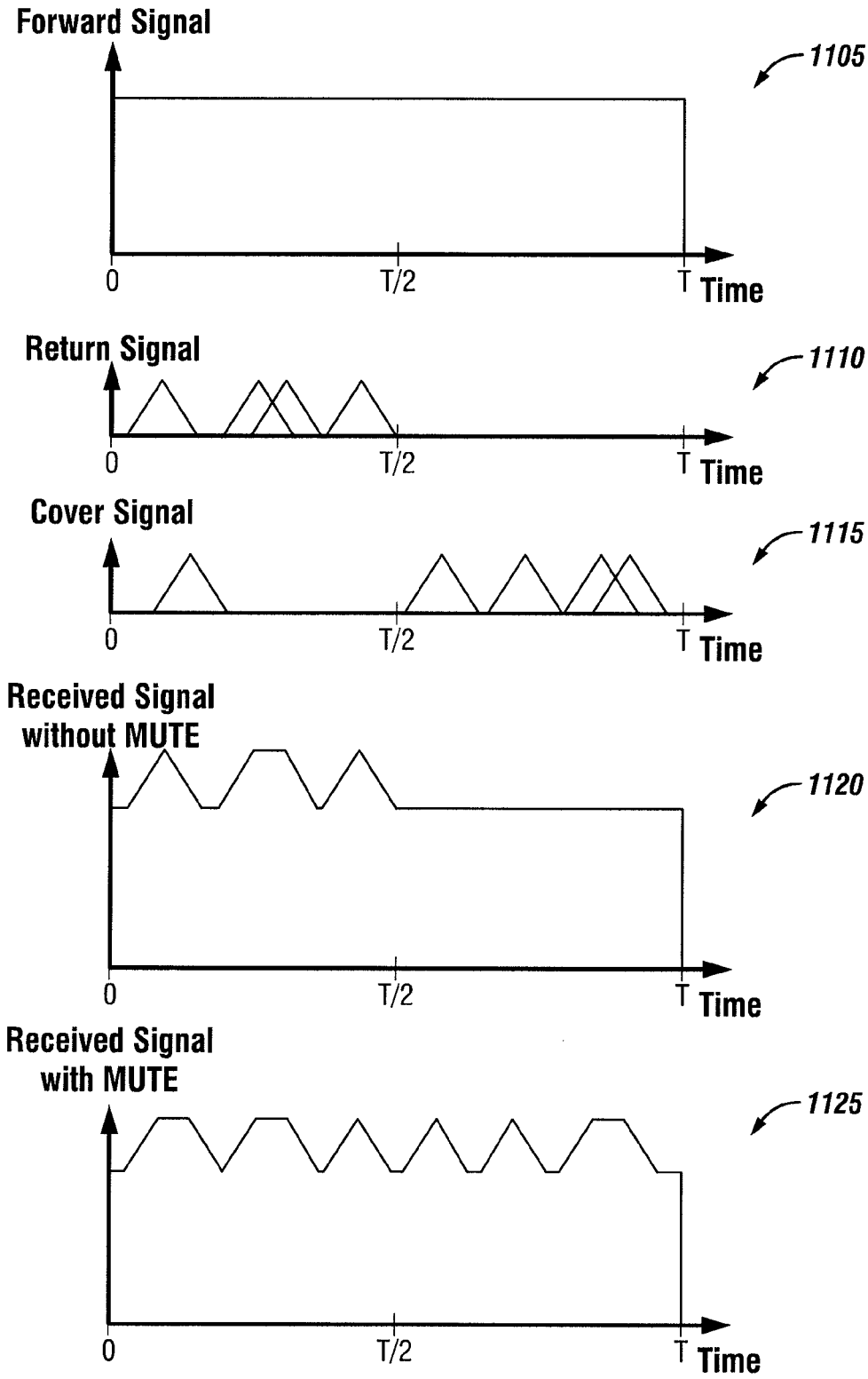
FIG. 11 provides an illustrative example of the effect that a cover signal will have on the downlink signal.

FIG. 11 provides an example of the effect of the cover signal. In this figure, the strong and steady (steady because the hub is always transmitting in the preferred implementation—however, this does not need to be the case) forward signal 1105 is depicted. For this example, the remote terminals 120 are transmitting during the first half of the period T and then stop during the second half. This is seen in the overall return signal 1110 depicted in the figure. A cover signal 1115 is chosen for this example and can be seen under the return signal 1110 in FIG. 11. Using the received signal (the forward signal and return signals added together) without 1120 an adversary could easily remove the forward signal 1105 and quantify the amount of remote traffic at any time. However, using the received signal with 1125 at the bottom of FIG. 11 it can be seen that by transmitting the cover signal, the return channel constantly looks busy regardless of the amount of actual remote traffic. It can also be seen that even if the forward signal were removed the adversary would have no way of knowing how much of the remaining signal is truly the return signal and not the cover signal.

Figure 12A:
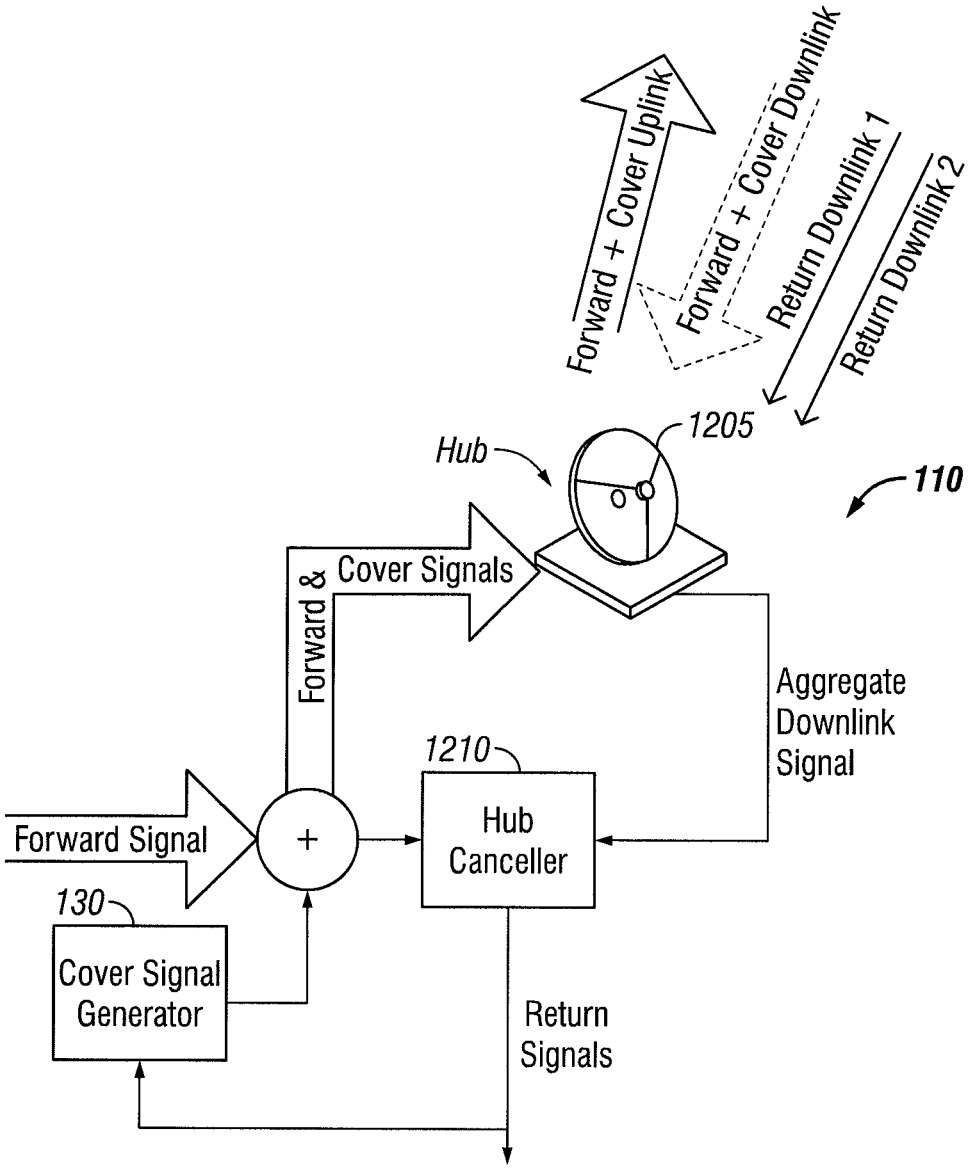
FIG. 12*a* is a simplified block diagram of the processing done at the hub of a frequency sharing system when a cover signal is generated and transmitted by the hub.

In one embodiment, the cover signal is generated and transmitted by the hub 110 along with the forward signal in an asymmetric, bent-pipe, frequency sharing satellite communication system. This may change the signal processing needed to be performed at the hub 110 from that of FIG. 8 to what is shown in FIG. 12*a*. In this figure the forward signal and cover signal are added together and directed to the antenna 1205 for transmission while also being fed into the hub canceller 1210 (which may comprise the canceller 135) to be subtracted out of the overall received downlink signal. This may be used if the user desires to remove the cover signal. Some users may instead simply treat the cover signal as an additional remote terminal traffic and forgo additional cancellation. As shown in this figure, the return signals at the output of the hub canceller 1210 can be used by the cover signal generator 130 to design an optimal cover signal. The cover signal can be modified so that the virtual traffic emitted by the hub 110 is based on the true traffic it receives from the remote terminals 120. Thus, the system could transmit the cover signal when there is a lull in the remote terminal traffic. It is important to note that the system may not be able to respond and adapt to instantaneous changes in traffic but rather may adjust its cover signal generation based on the slow moving trends.

Another benefit of the hub 110 having an almost constant update of channel conditions is in preventing an adversary from performing higher order analysis of the received signal. In some cases, a remote terminal 120 goes from being completely silent to constantly transmitting. One example of such behavior is the case of an unmanned aerial vehicle (UAV) entering an air space and transmitting a video signal. Even if an adversary is unable to tell apart the cover signal from the remote user traffic, a sudden increase in overall traffic might indicate a significant event. In order to reduce the likelihood of such an exploit, the cover signal generated by the hub 110 could vary the total amount of perceived traffic such that detection of a sudden spike in traffic would not be necessarily indicative of an actual event.

Figure 12B:
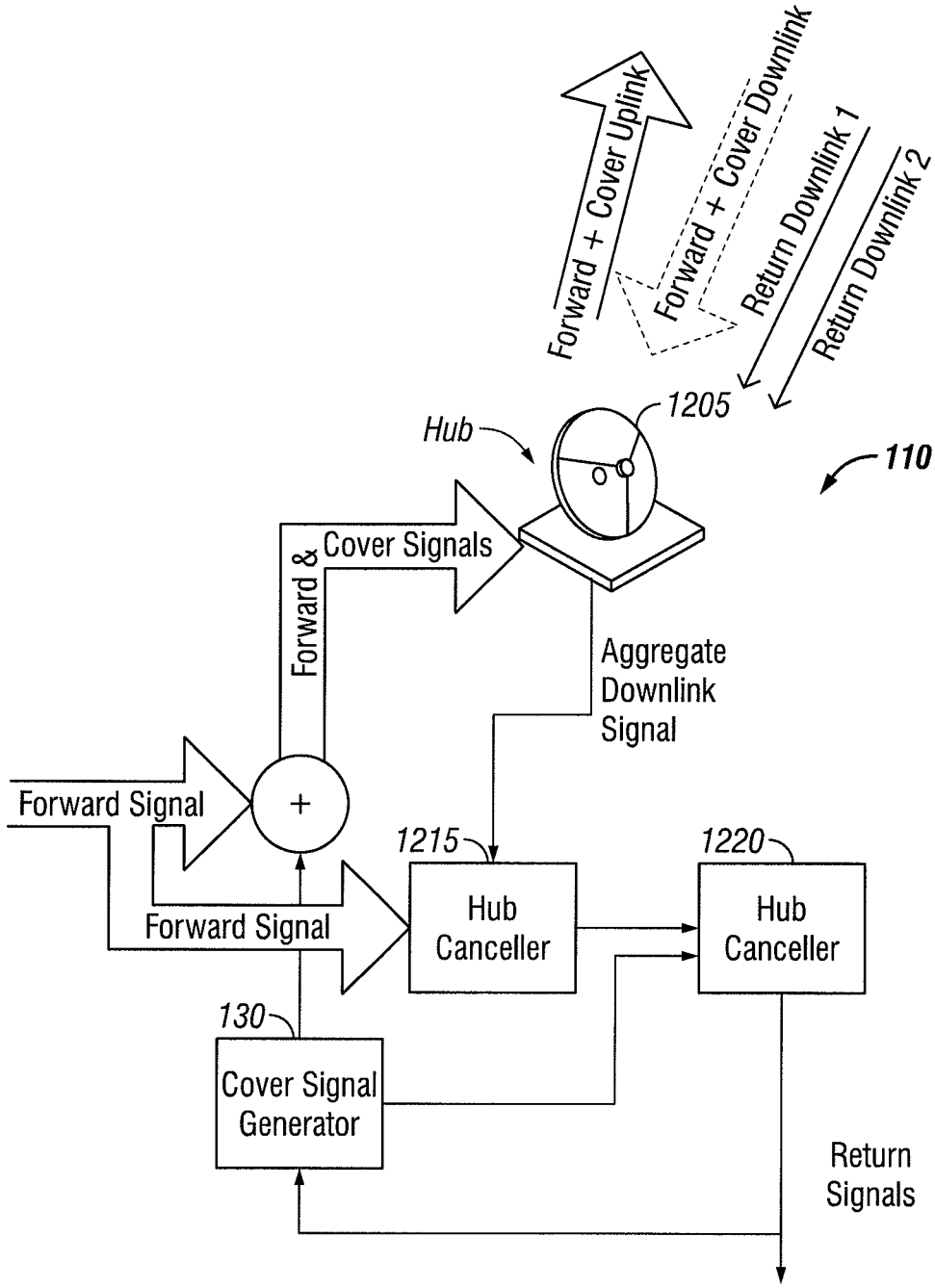
FIG. 12*b* is a simplified block diagram of the processing done at the hub when two hub cancellers are used to correct the effects caused by a non-linear system.

The block diagram in FIG. 12*a* shows that a single hub canceller 1210 can be used to remove the addition of the forward and cover signals from the downlink signal. This is true for a linear system in which superposition holds. In the linear case, the signal transmitted by the hub 110 forming the forward uplink, which is again the addition of the forward and cover signals, will be a known linear transformation of the signal that is received at the hub 110 forming the forward downlink. This allows the hub canceller 1210 to simply subtract the forward and cover signals from the overall downlink signal without losing return signal information. However, if the system is non-linear it may be better to use two hub cancellers in series where one is used to remove the forward signal and the other the cover signal because the combination of the two signals in the forward downlink is no longer a simple addition of the two signals. This two hub canceller configuration is seen in FIG. 12*b*. In this figure we see that the downlink signal is first fed into a hub canceller 1215 (which may be similar to hub canceller 810) for the removal of the forward signal and then this output is fed into a second hub canceller 1220 (which may be similar to canceller 135) which removes the cover signal.

Figure 13A:
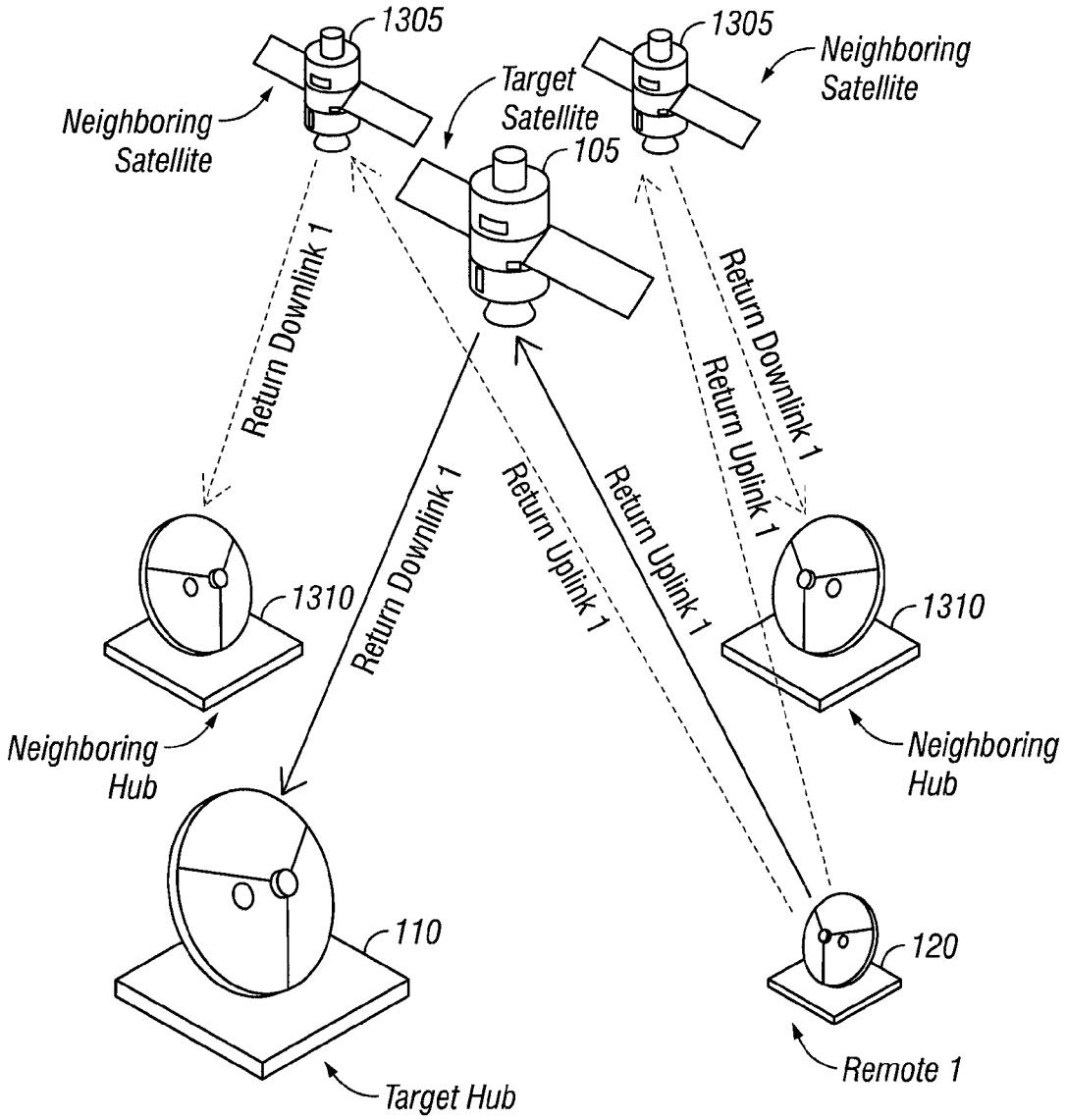
FIG. 13*a* shows the return uplinks from a remote terminal to both the target satellite and its neighboring satellites and the return downlinks from these satellites to their hub terminals.

In some cases, a determined adversary may try to obtain return signal information through "neighboring satellite triangulation." For example, with the remote terminals 120 transmitting their return signals using small antennas, the transmission is not precisely focused to the target satellite 105. The transmission power that is not received by the target satellite 105 is referred to as "off-axis" transmission power. Satellites placed in geostationary orbit are often given 2 degrees of separation from their neighboring satellites 1305. This means that a significant amount of off-axis transmission power may be received by the neighboring satellites 1305. This off-axis transmission is illustrated in FIG. 13*a*. In this figure, remote terminal 120 transmits return signal 1 using a small antenna. This establishes the intended return uplink 1 with the target satellite 105, depicted by the solid-lined arrow, and the unintended return uplinks with the neighboring satellites 1305 which are depicted by the dashed-lined arrows. As can also be seen in FIG. 13*a*, both the target satellite 105 and the neighboring satellites 1305 may transmit the return signal from remote terminal 120 down to their respective hubs 1310 on the downlink. This scenario depends on the frequencies used by the target 105 and neighboring 1305 satellites.

Figure 13B:
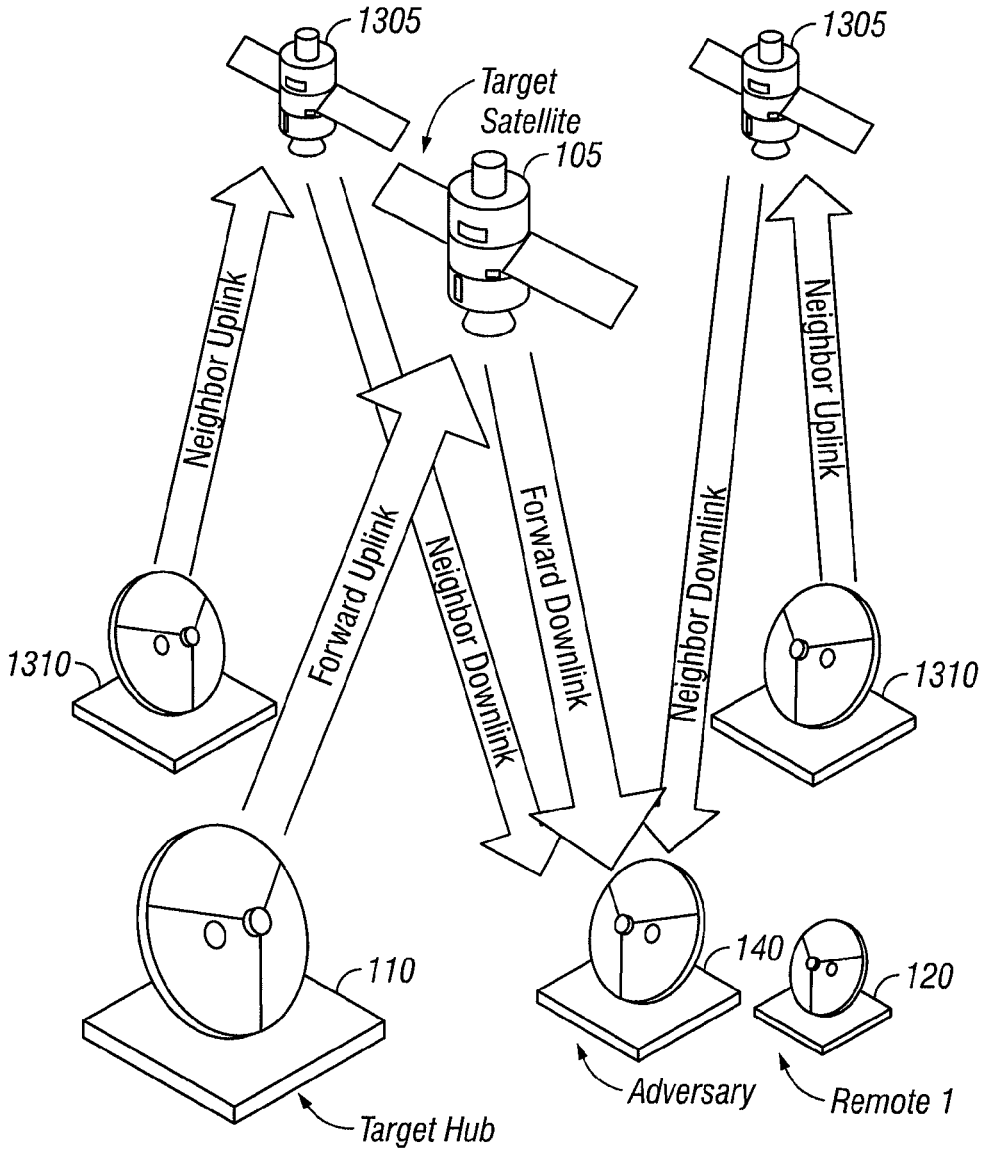
FIG. 13*b* shows the forward uplinks from the hubs of both the target satellite and its neighboring satellites and how an adversary is able to receive the forward downlinks from these satellites.

FIG. 13*b* shows how an adversary 140 in the vicinity of remote terminals 120 is able to receive the downlinks from both the target satellite 105 and the neighboring satellites 1305 using multiple antennas. This enables the adversary 140 to perform neighboring satellite triangulation, since these downlinks contain energy from the small antennas that are part of the network on the target satellite 105. Since, in this embodiment, the cover signal is generated only by the target hub 110 using a large antenna (making it more focused), the cover signal power will be primarily located at the target satellite 105. Thus the adversary 140 would be able to compare the downlink signal from the target satellite 105 and the neighboring satellites 1305 to tell apart the cover signal from the return signal traffic, assuming the intended signals on the neighboring satellites 1305 can be removed similar to the forward link on the target satellite 105, or if there are no intended signals occupying all or part of the bandwidth on the neighboring satellite 1305 that contains the return uplinks from the target network.

Figure 14:
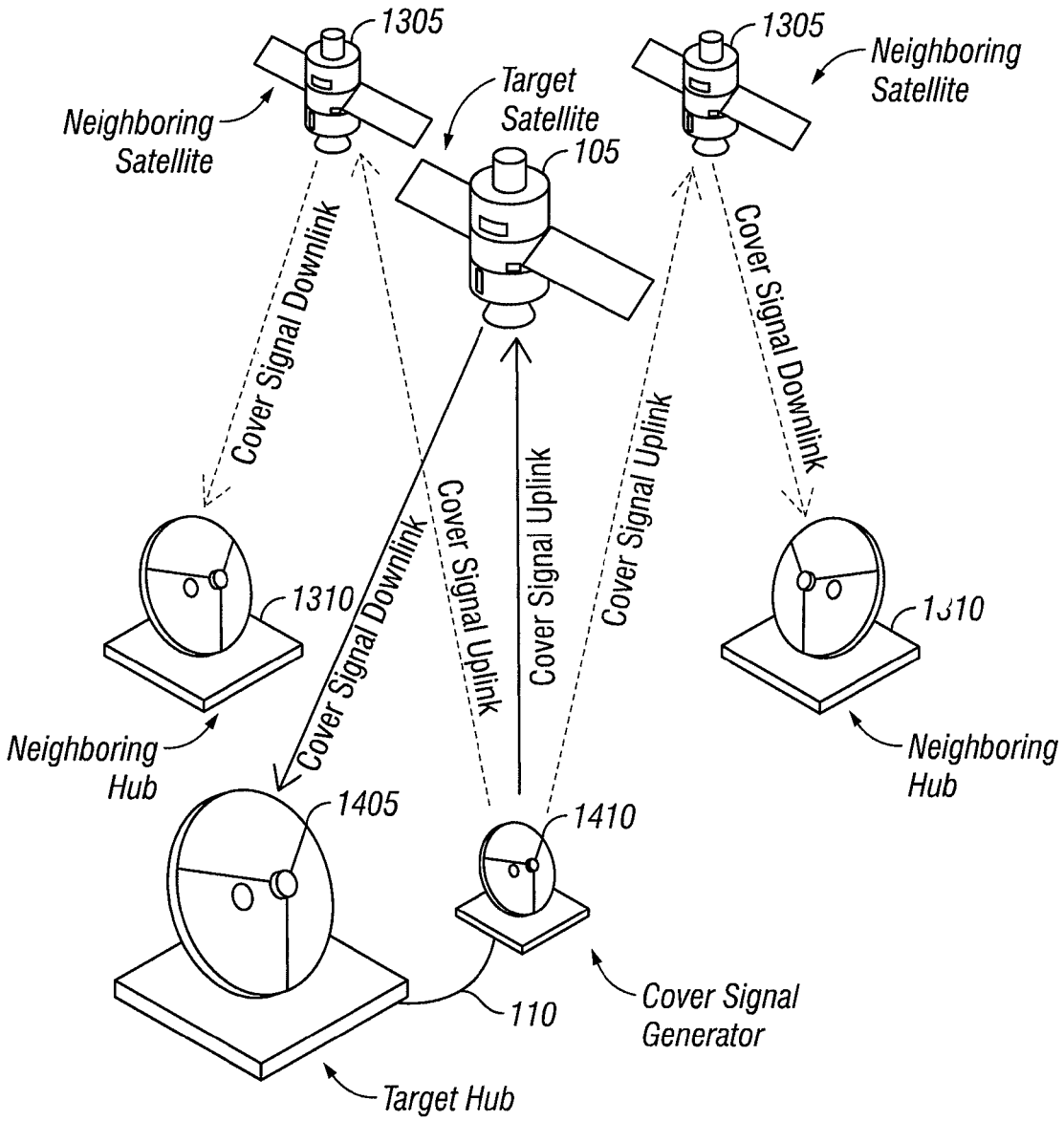
FIG. 14 shows the cover signal uplinks to both the target satellite and neighboring satellites and the cover signal downlinks from these satellites to their hub terminals when the cover signal is generated and transmitted by a small antenna near the target hub.

The threat of neighboring satellite triangulation, as described above, can be mitigated by transmitting the cover signal using transmit beam characteristics that are similar to (e.g. mimic) the transmit beam characteristics of the user terminals. For example, the cover signal may be generated by a small antenna 1410 or a small array of small antennas at the hub 110 rather than from the large hub antenna 1405. As can be seen in FIG. 14, when the cover signal is transmitted by a small antenna 1410 at the hub 110 the off-axis transmission power is received by the neighboring satellites 1305 so that both the target satellite 105 and the neighboring satellites 1305 receive the cover signal. This means that the downlink signals from three satellites, which can be received by the adversary 140 as seen in FIG. 13*b*, will all contain the cover signal thus minimizing the likelihood that the adversary 140 will be able to detect the true network traffic. In this case, the sum of the added cover signal plus the return link signals may have to comply with any adjacent satellite interference limits placed on the network operation by a regulatory authority. This would not likely be a consideration when the cover signal is transmitted by the large hub antenna 1405.

Figure 15A:
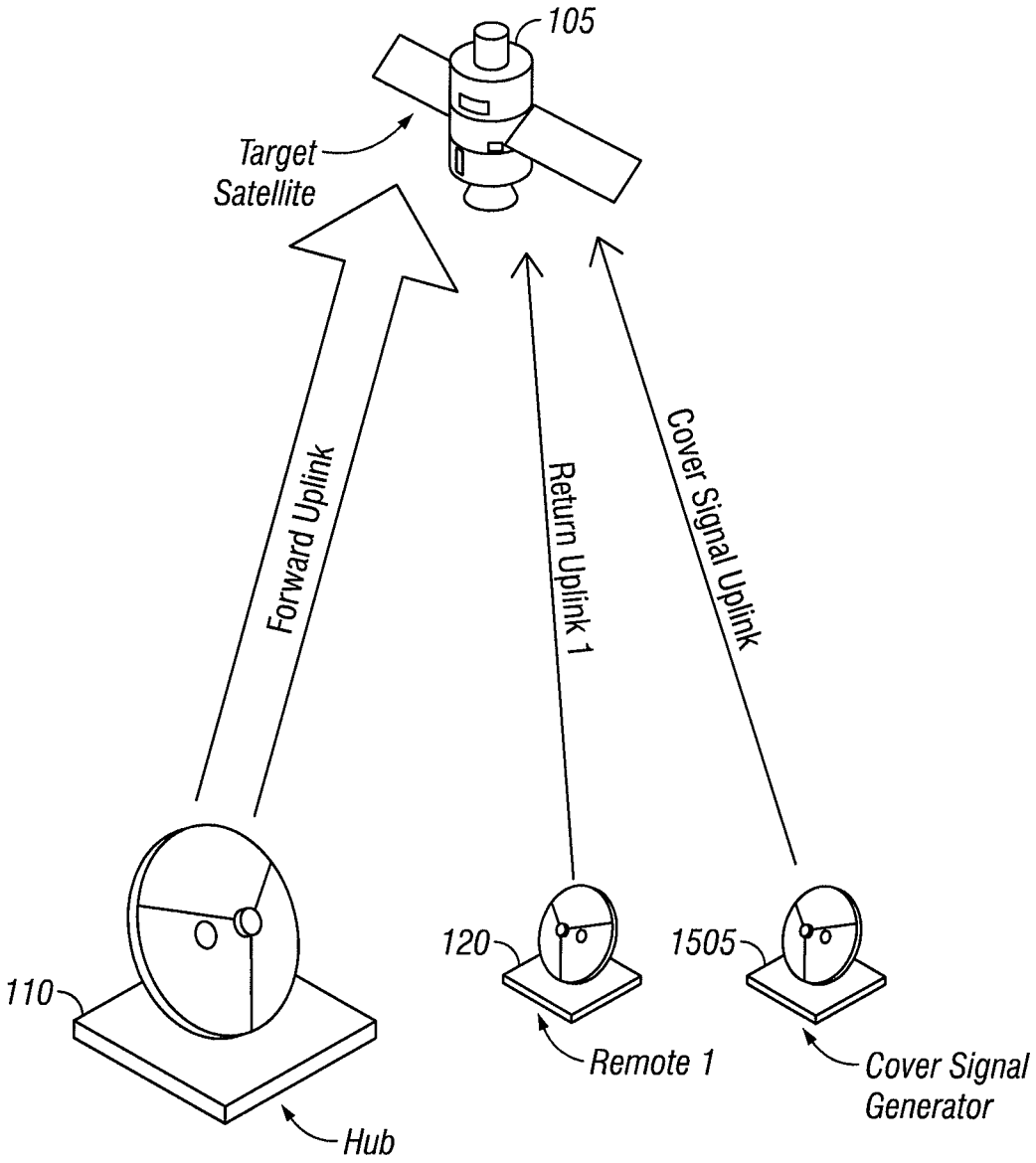
FIG. 15*a* shows the uplinks of an asymmetric satellite communication system when a cover signal is generated and transmitted by a small antenna in the vicinity of the remote terminals.
Figure 15B:
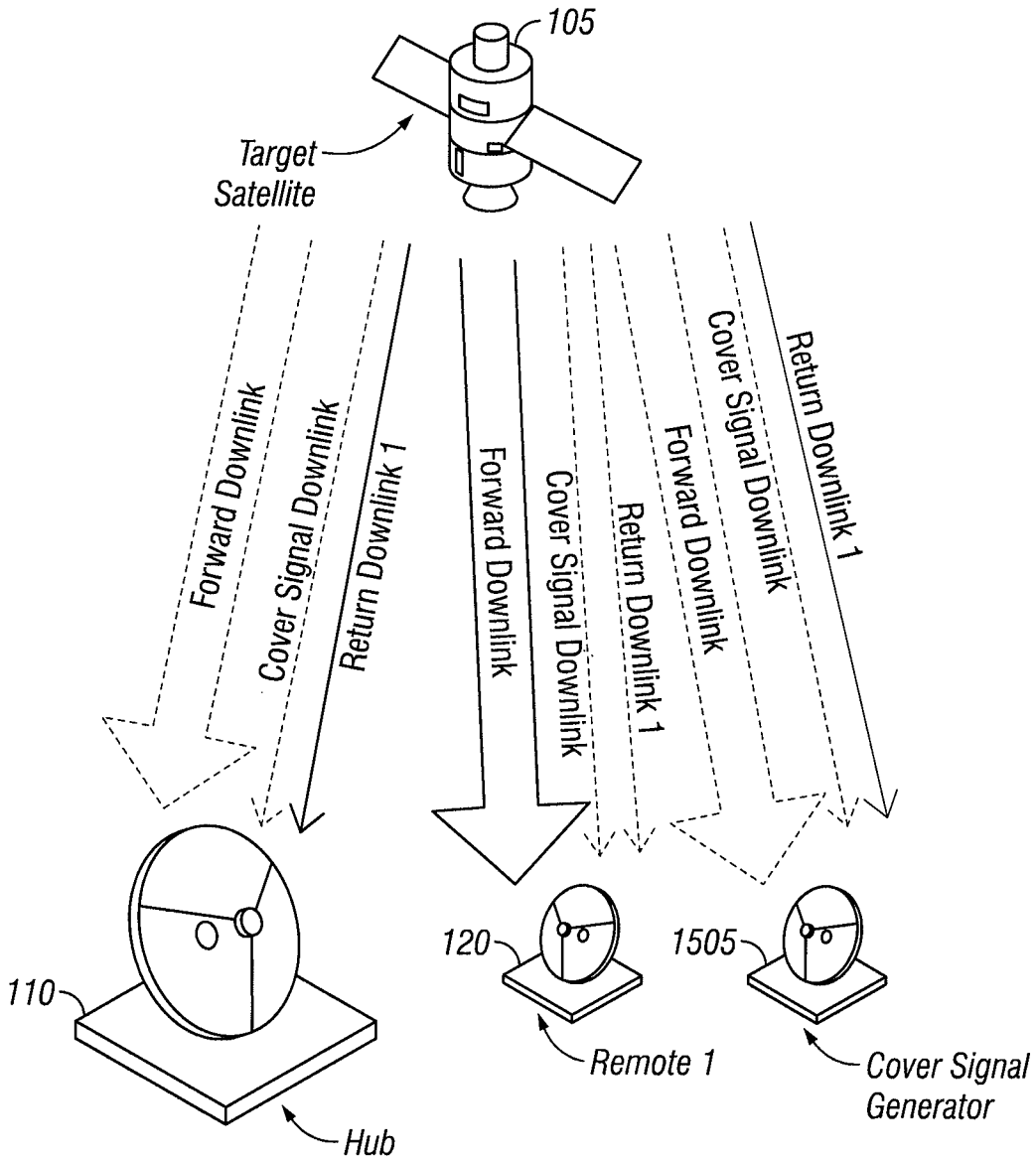
FIG. 15*b* shows the downlinks of an asymmetric frequency sharing satellite communication system when a cover signal is generated and transmitted by a small antenna in the vicinity of the remote terminals.

Another possible configuration of the system is to generate and transmit the cover signal using a small antenna in the vicinity or proximity of the remote terminals 120. In one embodiment, the size of the antenna used to transmit the cover signal is about the same as the size of antennas used by the remoter terminals 120 for communication. FIG. 15*a* shows the uplinks that would be established in such a configuration where only one remote terminal 120 is shown for clarity. FIG. 15*b* shows the downlinks that are formed in the configuration. Since the system in this configuration is still using frequency sharing (i.e. through a loopback satellite beam configuration), the hub terminal 110, remote terminal 120, and cover-signal-generating terminal 1505 all receive the downlink signals from their own transmission and the other terminals. Dashed-lined arrows are used in FIG. 15*b* for the downlinks that are not desired by the respective terminals.

As can be seen in FIG. 15*b*, the return downlink received by the cover-signal-generating terminal 1505 is depicted by a solid-lined arrow. This is due to the possibility that the cover-signal-generating terminal 1505 could use the return signal information, i.e., the remote traffic, to optimize the cover signal. This can be done, for example, by the cover-signal-generating terminal 1505 transmitting a signal to the hub 110, along with the cover signal, indicating that a predetermined change in the cover signal is about to be implemented due to an observed change in remote traffic. It should also be noted that the configuration shown in FIG. 15*a* and FIG. 15*b* is not subject to the threat of neighboring satellite triangulation because the cover signal and return signal are both transmitted from the same vicinity using a small antenna.

Figure 16:
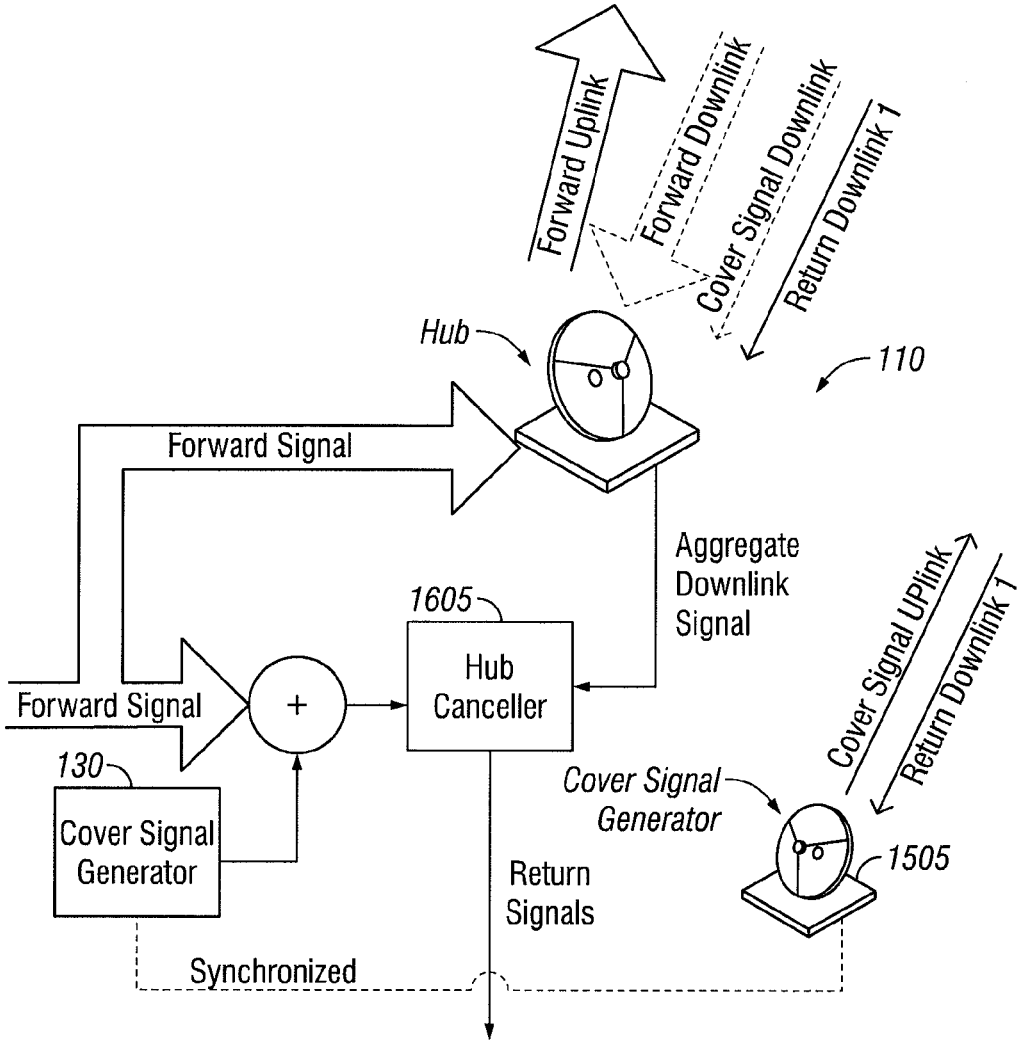
FIG. 16 is a simplified block diagram of the signal processing done at the hub of a frequency sharing system when a cover signal is generated and transmitted in the vicinity of the remote terminals.

FIG. 16 illustrates the essential steps of signal processing that would be carried out at the hub 110 in the configuration described by FIG. 15*a* and FIG. 15*b*. As can be seen in FIG. 16, the hub 110 receives the desired return signal along with the cover signal and the hub 110's own forward signal which together form the overall downlink signal. Thus, the forward signal and the cover signal both need to be cancelled out of the downlink signal in order to recover the return signals. The hub 110 already has access to the forward signal, but the cover signal is being generated and transmitted elsewhere. Therefore, the cover signal must also be generated at the hub 110 not for transmission but to be used by the hub canceller 1605 (which may be similar to hub canceller 810).

Shown in FIG. 16, a cover signal generator 130 is included at the hub 110 and is synchronized with the cover-signal-generating terminal 1505 so that the cover signal being fed into the hub canceller 1605 matches the one received in the downlink. This synchronization can be done, for example, by using a random number generator to help create the cover signal at both cover signal generators where the same "seed" or "key" is used by both to begin random number generation. This ensures that both sequences of numbers generated will be identical and thus the cover signals will be identical. This seed may be chosen for a specific system and, like a key, only known by the cover-signal-generating remote terminal 1505 and the hub 110's cover signal generator. Note that this is similar to how the encryption layer maintains synchronization between the hub 110 and remote terminals 120. Another option for cover signal generator synchronization is to have the cover signal generator 130 at the remote terminal side send real traffic containing information on how the cover signal is to be generated or modified.

The techniques described herein provide a much needed advancement in network information security. While many encryption methods prevent an adversary from gleaning the majority of the network information, they do nothing for preventing an adversary from analyzing important statistics (e.g, the amount or timing of traffic) of the traffic on the network. The method for traffic flow analysis mitigation hides the traffic information from an adversary with minimal cost or alterations to already existing systems. When the approach is used in an asymmetric frequency sharing satellite communication system, no additional hardware or adjustments need to be made to the remote terminals and few changes need to be made at the hub. The method effectively minimizes the negative impact of traffic flow analysis without reducing the throughput of the system or using additional remote terminal power. Also, in many systems the cover signal can be adjusted based on the real network traffic.

It should be noted that complete cancellation of the cover signal is not always necessary to retrieve remote terminal traffic when using the method. For example, as discussed above, in one embodiment, the system transmits the cover signal only when there is a lull in the remote terminal traffic. Accordingly, when the remote terminal traffic is transmitted, there is no cover signal transmitted, and therefore no cancellation is necessary. When the cover signal is transmitted, devices receiving the cover signal may simply ignore the cover signal. In another embodiment, cover signal packets may be transmitted in a manner that allows the packets to be distinguished from remote terminal traffic packets by authorized devices, while an adversary cannot. For example, the cover signal may be transmitted with a predetermined rotation of preambles that is known by authorized devices. Accordingly, if a packet is received with a certain preamble at a certain time, authorized devices know the packet is a cover signal packet and can ignore the packet.

It should further be noted that though described above with respect to certain communications systems, the cover signal systems and methods can be used with additional communications systems as well. For example, in some embodiment the cover signal systems and methods are described above with respect to satellite systems that use loopback satellite beams. However, the systems and methods can also be used with respect to cross-strap satellite systems.

In one or more exemplary embodiments, the functions described may be implemented in hardware, software, firmware, or any combination thereof. The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. If implemented in software, the functions may be stored on or transmitted over as one or more instructions or code on a computer-readable medium. As used herein, instructions refer to computer-implemented steps for processing information in the system. Instructions can be implemented in software, firmware or hardware and include any type of programmed step undertaken by components of the system. Computer-readable media includes both computer storage media and communication media including any medium that facilitates transfer of a computer program from one place to another. A storage media may be any available media that can be accessed by a processor. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. Combinations of the above should also be included within the scope of computer-readable media.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While the above description has pointed out novel features of the technology as applied to various embodiments, the skilled person will understand that various omissions, substitutions, and changes in the form and details of the device or process illustrated may be made without departing from the scope of the instant technology. Therefore, the scope of the technology is defined by the appended claims rather than by the foregoing description. All variations coming within the meaning and range of equivalency of the claims are embraced within their scope.

What is claimed is:

1. A method for inhibiting traffic flow analysis attacks in a wireless, multiple access communications network, the method comprising:

receiving, within the wireless, multiple access communications network, a composite signal comprising a cover signal and one or more real user transmissions over a period of time;

cancelling the cover signal from the composite signal to produce the one or more real user transmissions, the cancelling comprising:

determining one or more signal characteristics of the cover signal, re-creating a copy of the cover signal based at least in part on the determined one or more signal characteristics, and subtracting the copy of the cover signal from the composite signal to produce the one or more real user transmissions;

demodulating the one or more real user transmissions;

generating the cover signal, the cover signal comprising a number of simulated user transmissions over the period of time; wherein the cover signal is generated such that the composite signal comprises a total number of simulated and real user transmissions over the period of time that is varying regardless of a number of the one or more real user transmissions, wherein the simulated user transmissions and real user transmissions comprise similar preambles, and wherein the simulated user transmissions are generated to comprise fake traffic following the preambles to generate false remote terminals; and transmitting the cover signal.

2. The method of claim 1, wherein a first device receives the composite signal and a second device generates the cover signal and further comprising coordinating information regarding the cover signal between the first device and the second device.

3. The method of claim 1, wherein the one or more real user transmissions are transmitted by one or more user terminals having transmit beam characteristics, and wherein the cover signal is transmitted by a terminal having similar transmit beam characteristics.

4. The method of claim 3, wherein the terminal transmitting the cover signal is in proximity of at least one of the one or more user terminals, and wherein the one or more user terminals transmit the one or more real user transmissions using at least a first antenna of a first size, and the terminal transmits the cover signal using at least a second antenna of approximately the same size.

5. The method of claim 1, wherein a traffic volume of the cover signal is varied over time in a manner based at least in part on a traffic volume of the real user transmissions.

6. The method of claim 1, further comprising generating the cover signal such that the composite signal comprises spikes in encoded traffic that are not based on the one or more user terminal transmissions.

7. The method of claim 1, further comprising receiving the composite signal on a satellite; and generating and transmitting the cover signal from the satellite.

8. The method of claim 1, further comprising generating the cover signal such a number of simulated users is random and time-varying.

9. A system for inhibiting traffic flow analysis attacks in a wireless, multiple access communications network, the system comprising:

one or more user terminals configured to transmit a plurality of real user transmissions over a period of time within the wireless, multiple access communications network;

a cover signal generator configured to generate a cover signal comprising a number of simulated user transmissions over the period of time; and a cover signal canceller configured to:

receive a composite signal comprising the cover signal and the one or more real user transmissions; and cancel the cover signal from the composite signal to produce the one or more real user transmissions by:

determining one or more signal characteristics of the cover signal;

re-creating a copy of the cover signal based at least in part on the determined one or more signal characteristics; and subtracting the copy of the cover signal from the composite signal to produce the one or more real user transmissions, wherein the cover signal generator is further configured to generated the cover signal such that the composite signal comprises a total number of simulated and real user transmissions over the period of time that is varying regardless of a number of the one or more real user transmissions, and wherein the cover signal generator is further configured to generate the simulated user transmissions to comprise preambles similar to the preambles of the real user transmissions, and wherein the cover signal generator is further configured to generate the simulated user transmissions to comprise fake traffic following the preambles to generate false remote terminals.

10. The system of claim 9, wherein a hub terminal comprises the cover signal generator and the cover signal canceller.

11. The system of claim 9, wherein the user terminals and the cover signal generator have similar transmit beam characteristics.

12. The system of claim 11, wherein the user terminals and the cover signal generator use transmit antennas of similar size.

13. The system of claim 9, wherein the cover signal generator is configured to transmit coordinating information regarding the cover signal to the cover signal canceller.

14. An apparatus for inhibiting traffic flow analysis attacks in a wireless, multiple access communications network, the apparatus comprising:

a receiver configured to receive, within the wireless, multiple access communications network, a composite signal comprising a cover signal and one or more real user transmissions over a period of time;

a cover signal generator configured to generate the cover signal, the cover signal comprising a number of simulated user transmissions over the period of time, wherein the cover signal generator is further configured to generate the cover signal such that the composite signal comprises a total number of simulated and real user transmissions over the period of time that is varying regardless of a number of the one or more real user transmissions, wherein the cover signal generator is further configured to generate the simulated user transmissions to comprise preambles similar to the preambles of the real user transmissions, and wherein the cover signal generator is further configured to generate the simulated user transmissions to comprise fake traffic following the preambles to generate false remote terminals;

at least a first antenna configured to transmit the cover signal;

a canceller configured to cancel the cover signal from the composite signal to produce the one or more real user transmissions by:

determining one or more signal characteristics of the cover signal;

re-creating a copy of the cover signal based at least in part on the determined one or more signal characteristics; and subtracting the copy of the cover signal from the composite signal to produce the one or more real user transmissions; and a demodulator configured to demodulate the one or more real user transmissions.

15. The apparatus of claim 14, comprising user terminals transmitting the real user transmissions, wherein the user terminals and the cover signal generator have similar transmit beam characteristics.

16. The apparatus of claim 15, wherein the user terminals and the cover signal generator use transmit antennas of similar size.

17. The apparatus of claim 14, wherein a traffic volume of the cover signal is varied over time in a manner based at least in part on a traffic volume of the real user transmissions.

* * * * *